US007344444B2

(12) United States Patent
Suzuki

(10) Patent No.: US 7,344,444 B2
(45) Date of Patent: Mar. 18, 2008

(54) GAMING APPARATUS AND GAMING APPARATUS CONTROL METHOD

(75) Inventor: Takahiro Suzuki, Tokyo (JP)

(73) Assignee: ARUZE Co., Ltd., Tokyo (JP)

( * ) Notice: Subject to any disclaimer, the term of this patent is extended or adjusted under 35 U.S.C. 154(b) by 542 days.

(21) Appl. No.: 10/226,652

(22) Filed: Aug. 23, 2002

(65) Prior Publication Data

US 2003/0060282 A1 Mar. 27, 2003

(30) Foreign Application Priority Data

Aug. 24, 2001 (JP) ..... 2001-255067

(51) Int. Cl.
*A63F 9/24* (2006.01)

(52) U.S. Cl. ..... 463/36

(58) Field of Classification Search ..... 463/11–26, 463/1, 40–44; 273/143 R, 138.2
See application file for complete search history.

(56) References Cited

U.S. PATENT DOCUMENTS

| | | | | |
|---|---|---|---|---|
| 5,788,573 | A * | 8/1998 | Baerlocher et al. | 463/16 |
| 6,059,289 | A * | 5/2000 | Vancura | 273/143 R |
| 6,231,442 | B1 * | 5/2001 | Mayeroff | 463/20 |
| 6,234,897 | B1 * | 5/2001 | Frohm et al. | 463/20 |
| 6,315,660 | B1 * | 11/2001 | DeMar et al. | 463/16 |
| 6,347,996 | B1 * | 2/2002 | Gilmore et al. | 463/17 |
| 6,375,567 | B1 * | 4/2002 | Acres | 463/25 |
| 6,461,241 | B1 * | 10/2002 | Webb et al. | 463/20 |
| 6,491,584 | B2 * | 12/2002 | Graham et al. | 463/25 |
| 6,569,016 | B1 * | 5/2003 | Baerlocher | 463/16 |
| 6,634,943 | B1 * | 10/2003 | Baerlocher | 463/25 |
| 6,652,378 | B2 * | 11/2003 | Cannon et al. | 463/20 |
| 6,682,420 | B2 * | 1/2004 | Webb et al. | 463/16 |
| 6,685,561 | B2 * | 2/2004 | Anderson et al. | 463/16 |
| 6,705,944 | B2 * | 3/2004 | Luciano | 463/20 |
| 2002/0010017 | A1 * | 1/2002 | Bennett | 463/20 |
| 2003/0060266 | A1 * | 3/2003 | Baerlocher | 463/20 |
| 2003/0162583 | A1 * | 8/2003 | Baerlocher et al. | 463/20 |

FOREIGN PATENT DOCUMENTS

| | | |
|---|---|---|
| EP | 0 879 624 A2 | 11/1998 |
| EP | 1 083 531 A1 | 3/2001 |
| JP | 10/216299 A | 8/1998 |
| JP | 11-169505 | 6/1999 |
| JP | 11-244453 A | 9/1999 |
| JP | 11-253610 A | 9/1999 |
| JP | 11-276663 A | 10/1999 |

(Continued)

*Primary Examiner*—Robert E. Pezzuto
*Assistant Examiner*—Tramar Harper
(74) *Attorney, Agent, or Firm*—Collard & Roe, P.C.

(57) ABSTRACT

A gaming apparatus which is equipped with a basic game and bonus games and is improved in entertainment value by adopting a new type of game development. The gaming apparatus has a display having a plurality of display areas, on which areas symbols are to be displayed, and a controller. Under specific requirements irrelevant to a result of another bonus game, there is performed a corresponding bonus game matching the requirements. Further, at least one of a plurality of bonus games (i.e., a second bonus game) is executed when the specific requirements have been satisfied or when a specific result has been accomplished through another bonus game (i.e., a first bonus game).

27 Claims, 23 Drawing Sheets

FOREIGN PATENT DOCUMENTS

| | | | |
|---|---|---|---|
| JP | 11-290505 | | 10/1999 |
| JP | 2001-62027 | A | 3/2001 |
| JP | 2001-79139 | A | 3/2001 |
| JP | 2001-178868 | A | 7/2001 |
| JP | 2001-246044 | A | 9/2001 |
| JP | 2002-320713 | A | 11/2002 |
| JP | 2003-19242 | A | 1/2003 |
| JP | 2003-24510 | A | 1/2003 |
| JP | 2003-62171 | A | 3/2003 |
| JP | 2003-62176 | A | 3/2003 |
| JP | 2003-62177 | A | 3/2003 |
| JP | 2003-62178 | A | 3/2003 |
| JP | 2003-79931 | A | 3/2003 |
| JP | 2003-93586 | A | 4/2003 |
| JP | 2003-93587 | A | 4/2003 |
| WO | WO 00/12186 | | 3/2000 |

* cited by examiner (a)

FIG. 5

63

Pay Table

| Symbol - Kind | | 1K | 2K | 3K | 4K | 5K | pay |
|---|---|---|---|---|---|---|---|
| PIERROT | A | 2 | 10 | 100 | 1000 | 5000 | × line bet |
| GAL | B | | 10 | 25 | 200 | 500 | × line bet |
| LION | C | | 5 | 20 | 100 | 250 | × line bet |
| ELEPHANT | D | | 5 | 20 | 100 | 250 | × line bet |
| SEAL | E | | | 10 | 25 | 150 | × line bet |
| LOPE | F | | | 5 | 20 | 100 | × line bet |
| CLUB | G | | | 5 | 20 | 100 | × line bet |
| TENT | H | | | Tent Bonus Game | | | × line bet |
| TICKET | J | | | Super Circus Game | | | × total bet |
| BEAR | L | | | 2 | 5 | 20 | × total bet |

FIG. 6

75

| TYPES OF SYMBOLS | LETTERS | DETAILS OF BONUS |
|---|---|---|
| PIERROT | A | SHOWDOWN GAME OF PIERROT |
| GAL | B | GAL'S TRAPEZE |
| LION | C | LION'S JUMP THROUGH FIRE RING |
| ELEPHANT | D | ELEPHANT'S QUOITS GAME |
| SEAL | E | BET NUMBER X 2 |
| LOPE | F | BET NUMBER X 2 |
| CLUB | G | BET NUMBER X 2 |
| TENT | H | BET NUMBER X 2 |
| TICKET | J | PROCEEDING TO SECOND BONUS GAME |
| BEAR | L | BET NUMBER X 2 |

FIG. 7

REEL STRIP

64

| | Reel 1 | Reel 2 | Reel 3 | Reel 4 | Reel 5 |
|---|---|---|---|---|---|
| 1 | A | G | F | H | A |
| 2 | E | E | B | A | H |
| 3 | C | J | J | J | C |
| 4 | E | H | C | L | B |
| 5 | H | G | F | G | G |
| 6 | G | F | H | H | E |
| 7 | E | L | F | G | G |
| 8 | H | A | G | E | H |
| 9 | G | D | H | F | B |
| 10 | E | L | F | E | D |
| 11 | H | G | F | G | C |
| 12 | G | H | C | D | G |
| 13 | D | J | J | H | F |
| 14 | E | G | D | G | H |
| 15 | F | E | F | C | E |
| 16 | G | C | F | E | H |
| 17 | E | L | C | G | F |
| 18 | H | D | L | E | B |
| 19 | E | C | G | H | L |
| 20 | G | F | F | F | C |
| 21 | B | H | F | H | G |
| 22 | E | G | D | D | F |
| 23 | G | J | J | F | H |
| 24 | E | E | B | C | D |
| 25 | L | G | F | H | H |
| 26 | E | D | G | F | E |
| 27 | G | B | F | E | H |
| 28 | B | C | E | H | G |
| 29 | E | D | F | E | F |
| 30 | F | F | E | F | G |
| 31 | G | C | A | H | D |
| 32 | E | L | F | B | H |

B

S131
MOVE EACH TICKET SYMBOL TO CENTER ROW
S132
DISPLAY PIERROT CHARACTER
S133
SELECT STOP SYMBOL
S134
MOVE PIERROT
S135
STOP PIERROT
S136
IS COLLECT MARK DISPLAYED ON SYMBOL?
YES
NO
S137
DETERMINE TYPE OF SYMBOL
S138
A, B, C, D
E, F, G, H, L
SUB-GAME MODE
START SUB-GAME ACCORDING TO TYPE OF SYMBOL
DOUBLE REWARD OF BET NUMBER
S140
DISPLAY "COLLECT"
S141
S142
HAVE ALL SYMBOLS BEEN SELECTED?
NO
YES
END

FIG. 18

65

| TYPES OF SYMBOLS | LETTERS | DETAILS OF BONUS |
|---|---|---|
| PIERROT | A | SHOWDOWN GAME OF PIERROT |
| GAL | B | GAL'S TRAPEZE |
| LION | C | LION'S JUMP THROUGH FIRE RING |
| ELEPHANT | D | ELEPHANT'S QUOITS GAME |
| SEAL | E | BET NUMBER X 2 |
| LOPE | F | BET NUMBER X 2 |
| CLUB | G | BET NUMBER X 2 |
| TENT | H | BET NUMBER X 2 |
| BEAR | L | BET NUMBER X 2 |

GAMING APPARATUS AND GAMING APPARATUS CONTROL METHOD

CROSS REFERENCE T0 RELATED APPLICATIONS

Applicant claims priority under 35 U.S.C. §119 of Japanese Patent Application No. 2001-255067 filed Aug. 24, 2001.

BACKGROUND OF THE INVENTION

1. Field of the Invention

The invention relates to a gaming apparatus, a gaming apparatus control method, a program, and a computer-readable recording medium, wherein symbols are displayed in a plurality of display areas and an award is to be given to a player on the basis of the arrangement of symbols.

2. Background Art

A slot machine is a typical gaming apparatus which determines symbols to be displayed in a plurality of display areas through use of random numbers and determines occurrence of a win on the basis of the arrangement of symbols appearing in the display areas. By virtue of a recent game boom, slot machines have achieved high popularity in amusement arcades.

As measures for attracting a player's interests, slot machines provided with so-called bonus games have come into fashion. A reward or tokens are paid to a player in accordance with a result of a bonus game. Such slot machines having a so-called bonus game are becoming increasingly popular as compared with slot machines providing mere slot games.

The conventional gaming apparatus suffers the following problems. Namely, in the conventional gaming apparatus, when a predetermined arrangement has been determined by symbols in, e.g., a basic slot game, a bonus game is executed. After completion of the bonus game, the next slot game is started. Thus, the flow of games is comparatively monotonous. Therefore, players who seek excitation cannot be satisfied with a gaming machine with such an existing bonus game and await the advent of a new gaming apparatus.

The invention has been made to solve the drawback set forth and aims at providing a gaming apparatus, a gaming apparatus control method, a program, and a computer-readable recording medium, which offer a basic game and bonus games and enhance entertainment value by providing a new development of a game.

SUMMARY OF THE INVENTION (1) According to the present invention, a gaming apparatus is provided such that the apparatus comprises:

a display having a plurality of display areas in which a plurality of types of symbols are variably displayed; and a controller which executes a predetermined program and controls details to be displayed on the display, wherein the controller performs in accordance with the program:

an operation for determining the symbols to be displayed in the respective display areas from among the plurality of types of symbols and determining a win based on an arrangement of the symbols appearing in the respective display areas; and an operation for executing a second bonus game according to a predetermined condition when the predetermined condition has been satisfied, the second bonus game being selected from among a plurality of bonus games, and wherein the predetermined condition for executing the second bonus game is irrelevant to a result of a first bonus game having been executed; and wherein at least one of the bonus games is executed when either the predetermined condition has been satisfied or the predetermined result has been accomplished in the first bonus game.

According to another aspect of the present invention, a gaming apparatus is characterized by comprising:

a display having a plurality of symbol display areas in which a plurality of types of symbols are variably displayed; and a controller which executes a predetermined program and controls details to be displayed on the display, wherein the controller performs the following operations in accordance with the program:

an operation for determining the symbols to be displayed in the respective display areas from among the plurality of types of symbols and determining a win on the basis of the arrangement of the symbols appearing in the individual display areas; and an operation for executing a bonus game corresponding to the specific requirements from among the plurality of bonus games when the specific requirements have been satisfied, and wherein the specific requirements for executing the respective bonus games are irrelevant to a result of another bonus game; and wherein at least one of the bonus games is executed at any time when either the specific requirements have been satisfied or a specific result has been accomplished in another bonus game.

The gaming apparatus of the invention is provided with a plurality of types of bonus games, and each of the bonus games can be executed regardless of a result of another bonus game when a predetermined condition has been satisfied. Here, the satisfaction of the predetermined condition may include, by way of example, a case where a predetermined random number is obtained. At least one of the plurality of bonus games is executed even when a specific result or a predetermined result has been accomplished in another bonus game, which was executed. In other words, according to the invention, the player can proceed from a basic game to a plurality of bonus games. Further, the player may proceed from at least one bonus game to another bonus game. Such a new development of the game may be adopted in an embodiment according to the present invention, thereby enhancing entertainment value.

More preferably, in any one of the plurality of bonus games, the controller may select any one of the plurality of types of symbols appearing in the plurality of display areas on the display; and executes another bonus game in accordance with the type of the selected symbol.

In this way, when a bonus game is executed in accordance with the type of the symbol selected in another bonus game, the player can enjoy selecting any symbols corresponding to the bonus game in the another bonus game, thereby enhancing entertainment value.

(2) According to the present invention, it is provided with a slot machine which includes a display having a plurality of display areas in which a plurality of types of symbols are variably displayed, and which determines occurrence of a win based on an arrangement of symbols appearing in the respective display areas, the machine comprising:

determination means for determining whether or not a predetermined condition for execution of each of a plurality of bonus games has been satisfied; and execution means for executing a bonus game according to the predetermined condition when the determination means determines that the predetermined condition has been satisfied, wherein the predetermined condition for executing the bonus game is irrelevant to a result of another bonus game having been executed; and, wherein the execution means executes at least one of the bonus games when either the predetermined condition has been satisfied or a predetermined result has been accomplished in the another bonus game having been executed.

According to another aspect of the present invention, it is provided with a slot machine which includes a display having a plurality of display areas in which a plurality of types of symbols are variably displayed, and which determines occurrence of a win on the basis of an arrangement of symbols appearing in the respective display areas, the machine comprising:

determination means for determining whether or not specific requirements or a predetermined condition pertaining to execution of a plurality of bonus games has been satisfied; and execution means for executing the bonus game corresponding to the specific requirements or the predetermined condition when the specific requirements or the predetermined condition is determined to have been satisfied, wherein the specific requirements or the predetermined condition to be used for executing a bonus game is irrelevant to a result of another bonus game; and, wherein the execution means can execute at least one of the bonus games when either the specific requirements or the predetermined condition has been satisfied for the at least one of the bonus games or a specific result has been accomplished in the another bonus game, which was executed.

According to the present invention, a slot machine is provided with a plurality of types of bonus games, and each bonus game may be executed regardless of a result of another bonus game when specific requirements or a predetermined condition has been satisfied. Further, at least one of the plurality of bonus games may be executed even when a specific result has been accomplished in another bonus game, which was executed. In other words, according to the invention, the player can proceed from a basic game to any of a plurality of bonus games. Further, the player can proceed from at least one bonus game to another bonus game. Such a new development of the game may be adopted in accordance with the present invention, thereby enhancing entertainment value.

More preferably, the slot machine further comprises:

selection means for selecting any of the plurality of types of symbols appearing in the plurality of display areas on the display in a first bonus game from the plurality of types of bonus games; and storage means for storing a table showing a correspondence between the plurality of types of symbols and contents, including the bonus games, of bonuses to be awarded to the player, wherein the execution means executes a bonus game on the basis of the correspondence in the table stored in the storage means in accordance with the type of the symbol selected in the first bonus game.

In this way, when a bonus game is executed in accordance with the type of the symbol selected in the first bonus game, the player can enjoy selection of a symbol corresponding to the bonus game in the first bonus game, thereby enhancing entertainment value.

(3) According to the present invention, a method is provided for controlling a gaming apparatus which includes a display having a plurality of display areas in which a plurality of types of symbols are variably displayed, and a controller for controlling details to be displayed on the display, the method comprising:

executing a basic game in which the symbols to be displayed in the respective display areas are selected and determined from among the plurality of types of symbols and in which a win based on an arrangement of the symbols displayed in the respective display areas is determined; and executing a bonus game according to a predetermined condition when the predetermined condition has been satisfied, the bonus game being selected from among a plurality of bonus games;

wherein the predetermined condition for executing the bonus game is irrelevant to a result of another bonus game; and wherein at least one of the bonus games is executed when either the predetermined condition has been satisfied or a predetermined result has been accomplished in the another bonus game.

According to another aspect of the present invention, a method is provided with a gaming apparatus control method for controlling a gaming apparatus which includes a display having a plurality of symbol display areas in which a plurality of types of symbols are variably displayed, and a controller for controlling contents to be displayed on the display, the method comprising:

a step of executing a basic game in which a determination is made as to the symbols to be displayed in the respective display areas from among the plurality of types of symbols and occurrence of a win on the basis of an arrangement of the symbols displayed in the respective display areas; and when specific requirements or the predetermined condition has been satisfied, a step of executing a bonus game corresponding to the specific requirements or the predetermined condition from among a plurality of bonus games, wherein the specific requirements or the predetermined condition to be used for executing each bonus game is irrelevant to a result of another bonus game; and, wherein at least one of the bonus games is executed when either the specific requirements or the predetermined condition has been satisfied or a specific result has been accomplished in another bonus game, which was executed.

In accordance with the present invention, it is provided with a plurality of types of bonus games, and each bonus game can be executed regardless of a result of another bonus game when specific requirements or a predetermined condition has been satisfied. Further, at least one of the plurality of bonus games is executed even when a specific result has been accomplished in the another bonus game. In other words, according to the invention, the player can proceed from a basic game to any of the plurality of bonus games. Further, the player may proceed from at least one bonus game to another bonus game. Such a new development of the game may be adopted in accordance with the present invention, thereby enhancing entertainment value.

More preferably, the method for controlling a gaming apparatus further comprises:

a step in which the controller selects any one of the plurality of types of symbols appearing in the plurality of display areas on the display in one of the plurality of bonus games; and a step of executing another bonus game according to the type of the selected symbol in the one of the plurality of bonus games.

In this way, since another bonus game may be executed in accordance with the type of the symbol selected in a certain bonus game, the player can enjoy selection of such a bonus game in the certain bonus game, thereby enhancing entertainment value.

(4) According to the present invention, a program is provided with a computer executable program to be used for executing:

displaying, on a display, a plurality of display areas in which a plurality of types of symbols are to be displayed;

executing a basic game in which the symbols to be displayed in the respective display areas are selected and determined from among the plurality of types of symbols and in which a win based on an arrangement of the symbols displayed in the respective display areas; and executing a bonus game according to the predetermined condition when the predetermined condition has been satisfied, the bonus game being selected from among a plurality of bonus games;

wherein the predetermined condition to be used for executing the bonus game is irrelevant to a result of another bonus game; and, wherein at least one of the bonus games is executed when either the predetermined condition has been satisfied or a predetermined result has been accomplished in the another bonus game.

In accordance with another aspect of the present invention, a program is provided with a program to be used for executing a step of displaying, on a display, a plurality of display areas in which a plurality of types of symbols are to be displayed;

a step of executing a basic game in which a determination is made as to the symbols to be displayed in the respective display areas from among the plurality of types of symbols and occurrence of a win on the basis of an arrangement of the symbols displayed in the respective display areas; and a step of executing a bonus game corresponding to specific requirements or a predetermined condition when the specific requirements or the predetermined condition has been satisfied, the program being selected from among a plurality of bonus games;

wherein the specific requirements or the predetermined condition to be used for executing each bonus game is irrelevant to a result of another bonus game; and, wherein at least one of the bonus games is executed when either the specific requirements or the predetermined condition has been satisfied or a specific result has been accomplished in the another bonus game.

(5) According to the present invention, it is also characterized by a computer-readable recording medium on which the program set forth is recorded.

By means of the program set forth and by means of causing a computer to execute such a program recorded on a recording medium, there can be yielded advantages such as those described in connection with the gaming apparatus and the method of controlling the gaming apparatus. Specifically, processing can proceed from a basic game to any of a plurality of bonus games such that the player can proceed from the basic game to a bonus game. Further, processing can proceed from at least one bonus game to another bonus game such that the player can proceed from at least one of the bonus games to another bonus game. Thus, a new type of development of the game can be implemented, thereby enhancing entertainment value.

BRIEF DESCRIPTION OF THE DRAWINGS

FIG. 5 is a view of a payment table of the slot machine.

FIG. 6 is a table showing a correlation between symbols to be selected in a first bonus game and contents of the bonus game.

FIG. 7 is a symbol table showing symbols to be displayed on respective reels.

FIG. 18 is a table showing a correspondence between symbols to be selected in the second game and contents of the bonus game.

DETAILED DESCRIPTION OF THE INVENTION

Figure 1:
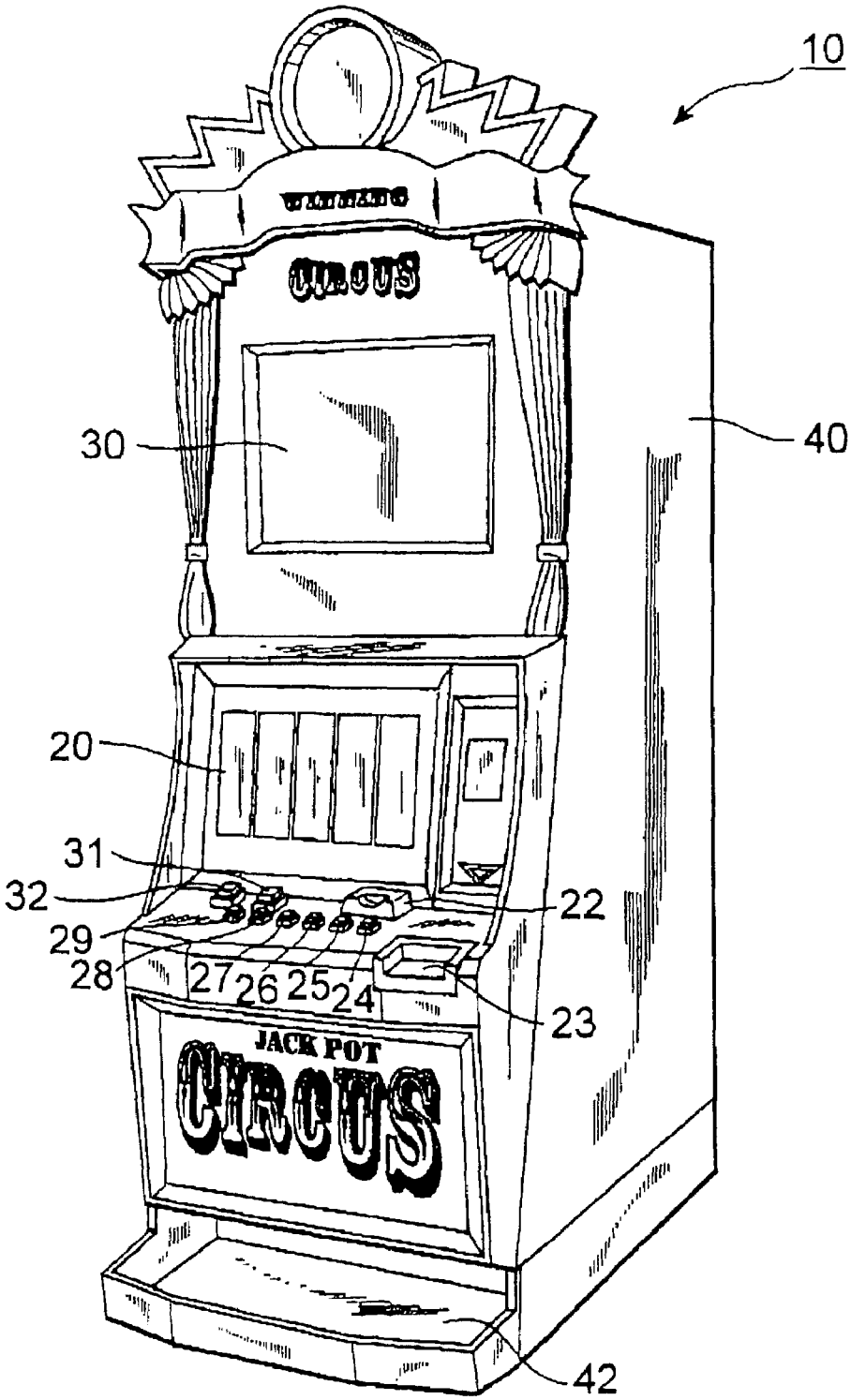
FIG. 1 is an external perspective view showing a gaming apparatus (slot machine) according to the present invention.

A preferred embodiment of the invention will be described in detail hereinbelow by reference to the accompanying drawings. Like elements are assigned like reference numerals, and their repeated explanations may be omitted.

FIG. 1 is an external perspective view showing a slot machine (gaming machine) 10 of this embodiment. The slot machine 10 has a display 20 which is provided in a lower portion of a housing 40 and digitally displays a slot game and a plurality of bonus games. A second display 30 is provided in an upper portion of the housing 40 for digitally displaying a sub-game to be described later or a like game. The main display 20 and the second display 30 are both liquid-crystal display devices. The main display 20 serves as a touch screen. As will be described in detail later, two types of bonus games are available, that is, a first bonus game and a second bonus game.

A coin insertion part 22 by way of which mediums, such as tokens or coins (hereinafter generically called "coins") and a bill insertion part 23 (or a paper money insertion part 23) to be used for insertion of a bill (or paper money) are provided in a lower area in front of the main display 20. A player can play slot games with either coins or a bill. As a matter of course, the slot machine may be configured so as to enable the player to play games with only coins or with only a bill. Further, a coin receiving part 42 for receiving paid out coins is provided in the lowest portion of the housing 40.

Six press buttons are arranged in an area in front of the coin insertion part 22. Those buttons are also provided on a known slot machine. Specifically, among those buttons the rightmost button is a start button 24 to be used for instructing initiation of spinning of symbols, and the remaining buttons are, from right to left, a BET button 25 to be used for instructing a 1 BET action; a MAX BET button 26 to be used for betting the maximum number of coins (e.g., 30 coins) from remaining credits; a REPEAT BET button 27 to be used for betting the same number of coins as those bet in a previous session; a collect button 28 to be used for determining coins acquired in games; and a payout button 29 to be used for instructing payout of coins. Further, two selection buttons 31, 32 are provided on the left side of the coin insertion part 22 in the drawing, and these buttons are to be used for a game which proceeds on the second display 30.

Figure 2:
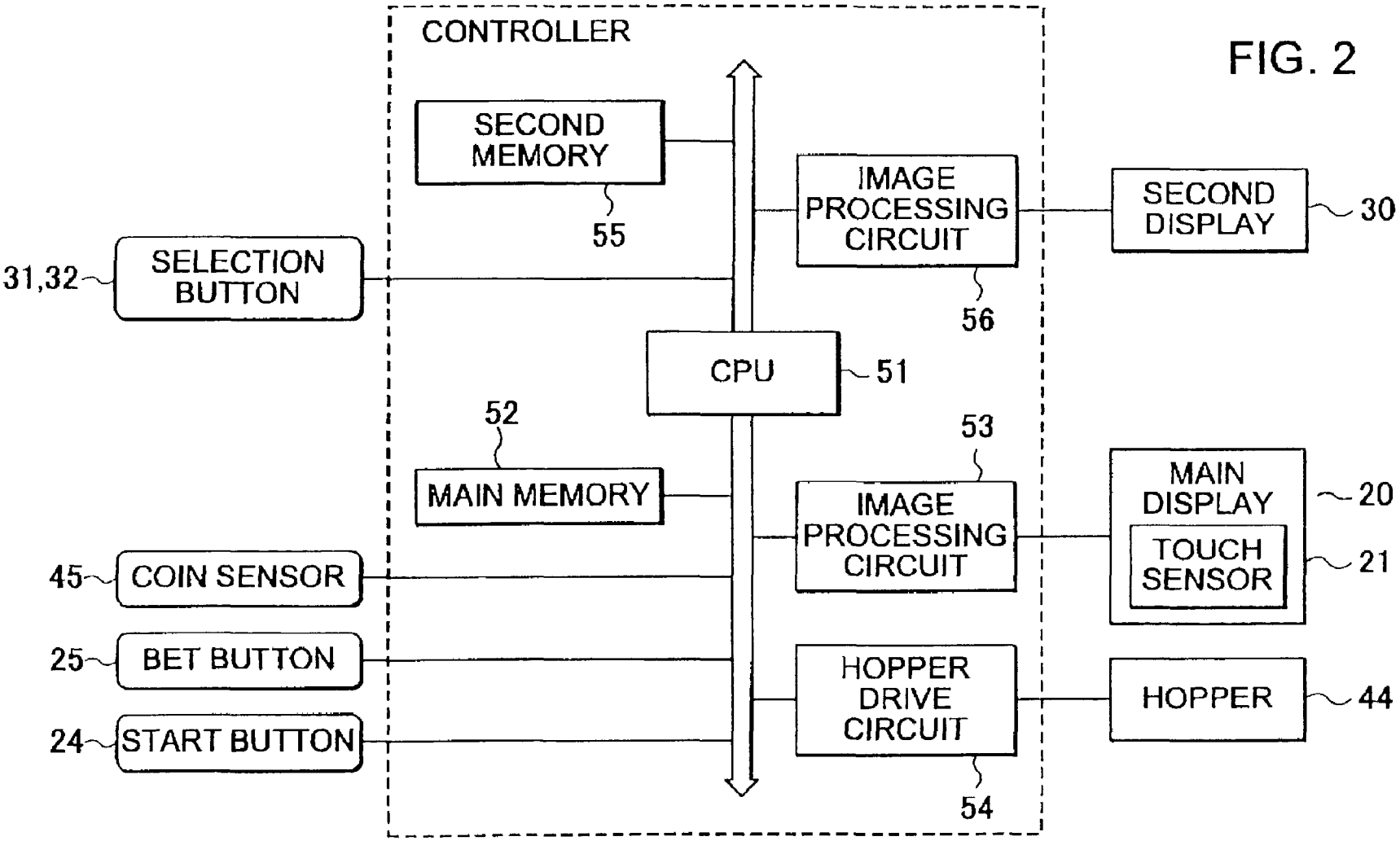
FIG. 2 is a block diagram showing a controller for controlling processing of the slot machine shown in FIG. 1.

FIG. 2 is a block diagram showing a controller 50 for controlling processing of the slot machine 10 of this embodiment and various actuators electrically connected to the controller 50.

The controller 50 includes a CPU 51 having control over various control operations; main memory 52 serving as storage means for storing a program and data required for executing a slot game; an image processing circuit 53 which has video RAM and controls contents to be displayed on the main display 20; a hopper drive circuit 54 for controlling a hopper 44 for paying accumulated coins to the player; second memory 55 serving as storage means which stores a program and data required for executing a sub game; and an image processing circuit 56 which has VIDEO RAM and controls contents to be displayed on the second display 30. Here, an I/O port or like devices are interposed between the CPU 51 and the actuators, when necessary.

The main memory 52 has a ROM area and a RAM area. Stored in the ROM area are at least a program including modules to be used for executing a slot game and individual bonus games, and data pertaining to images of a pay table showing payments corresponding to the arrangement of symbols and symbol images. Variable data, such as player's BET number (or the number of coins bet by the player) and credit number (or the number of credits), are written into the RAM area of the main memory 52. Similarly, the second memory 55 also has a ROM area and a RAM area. Programs and data pertaining to a plurality of sub games are written in the ROM area. A touch sensor 21 is built into the main display 20, and the player can enter various information items by means of touching the screen of the display.

Moreover, the CPU 51 is connected to a coin sensor 45, a start button 24, the BET button 25, and the selection buttons 31, 32 by way of a bus. Although omitted from the drawings, various other buttons and a bill sensor are also connected to the controller 50. Moreover, the hopper 44 and the coin sensor are housed in the housing 40 shown in FIG. 1.

Figure 3:
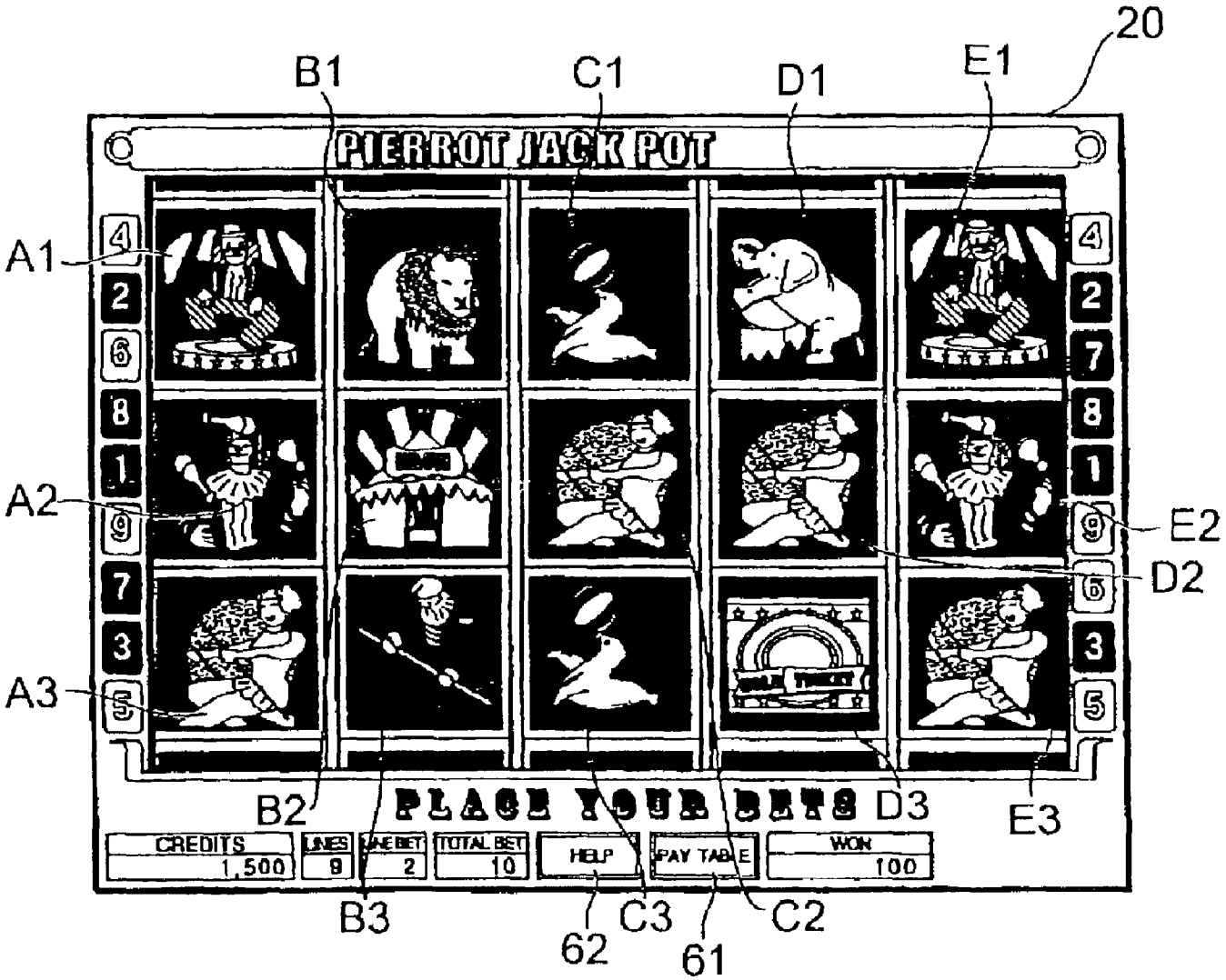
FIG. 3 is a view showing a display screen of a main display.

FIG. 3 is a view showing a display screen of the main display 20. In this embodiment, the main display 20 has a total of 15 display areas in which a plurality of symbols are to be displayed, the areas being arrayed into a matrix of three rows and five columns. Reels, on whose outer peripheral surfaces a plurality of types of symbols are printed, are spun. When the reels have come to a standstill, images are processed such that selected symbols are displayed in the display areas A1 through A3; B1 through B3; C1 through C3; D1 through D3; and E1 through E3.

Displayed below the individual display areas are the number of remaining credits, the number of valid lines (LINES), BET number on each line [or the number of coins bet on respective lines] (LINE BET), a total number of coins bet by the player this time (TOTAL BET), and the number of coins awarded to the player this time as a reward (WON). Further, a PAY TABLE key 61 for instructing indication of a pay table showing the amount of payment to the player and a HELP key 62 for seeking help for uncertainties about the way of playing a game are also displayed on the main display 20. When the player has touched any of the keys 61, 62, the touch sensor 21 senses the touch, whereupon explanations about a pay table and an operating method are displayed on the screen.

Figure 4:
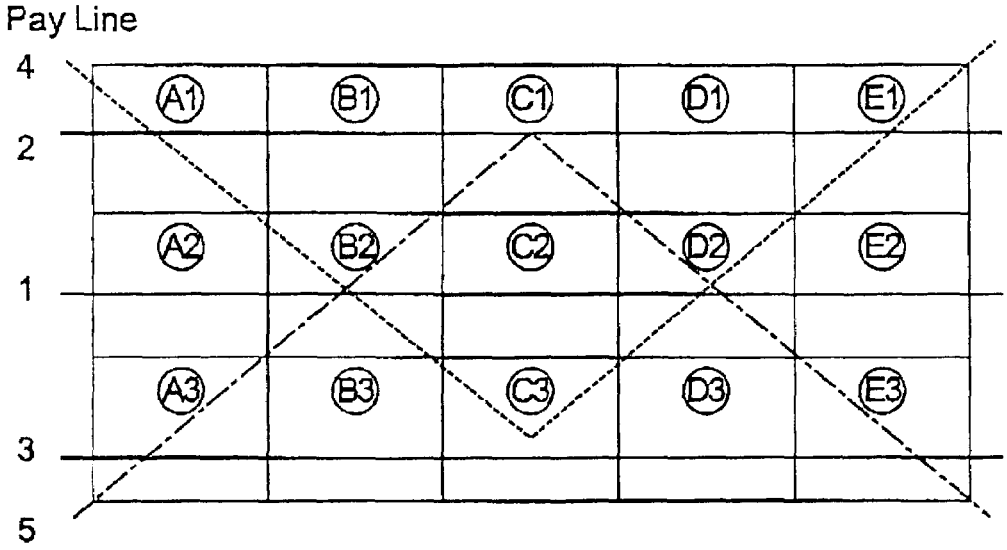
FIGS. 4A and 4B are views showing payment lines of a slot machine 10.
Figure 4:
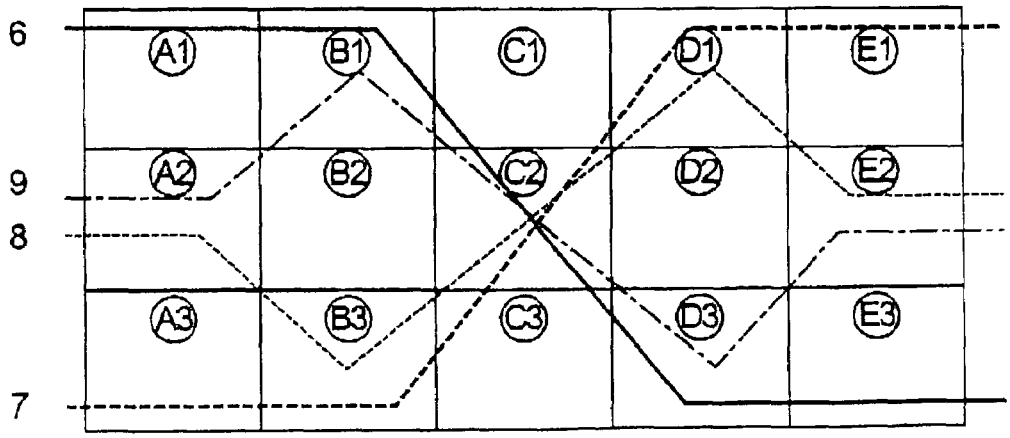

FIGS. 4A and 4B are views showing payment lines of the slot machine 10. In order to facilitate comprehension of the invention, the payment lines are shown in the form of two drawings. As shown in individual drawings, nine payment lines are available in the game. When predetermined symbols are aligned along any of the payment lines, a reward corresponding to the nature of the arrangement is paid. In this way, in this embodiment, the number of payment lines is increased by adoption of a 3-by-5 array, thereby enabling provision of a variety of payment lines.

FIG. 5 is a view showing a payment table 63 of the slot machine 10. As mentioned above, information about the payment table 63 is stored in the main memory 52 beforehand. When the player touches the PAY TABLE key 61 of the main display 20, the payment table 63 appears on the screen. In the slot game, symbols are ranked in the order of CLOWN, GAL, LION, ELEPHANT, SEAL, ROPE, CLUB, TENT, TICKET, and BEAR. Here "CLOWN" is shown as "PIERROT" in FIG. 5 and referred to "PIERROT" hereafter. In order to classify symbols, the symbols are assigned reference codes A to G, J, and L. By way of example, when three ROPE symbols are aligned from left to right, a payment which is five times as many as the BET number (or the number of coins bet) of the reels on the payment line along which the symbols are aligned is awarded.

A ticket symbols indicated by letter "J" is a bonus symbol to be used for starting the first and second bonus games. Ticket symbols are to be displayed on the second, third, and fourth reels. The left symbol has letters "CIR" printed thereon in the form of a swath; the center symbol has letters "CUS" printed thereon in the form of a swath; and the right symbol has letters "GOLD TICKET" printed thereon in the form of a swath (see FIG. 13). In short, no ticket symbol appears in the leftmost display area and the rightmost display area.

Although described in detail later, proceeding to a second bonus game is determined when ticket symbols are displayed on the second, third, and fourth reels, regardless of the lines. Here, the ticket symbols appear in the respective columns when specific numbers are achieved from random numbers which are determined by a program. In other words, in order to execute a second bonus game, specific requirements must be satisfied, such as random numbers assuming predetermined numbers.

In the second bonus game, the ticket symbols are moved to center display areas B2, C2, and D2. Subsequently, a pierrot (or a clown) character appears on the main display 20 and moves around the ticket symbols, thereby selecting any of the symbols appearing around the ticket symbols. Contents of a bonus to be afforded to the player are determined in accordance with the kind of the thus-selected symbol.

In this way, the second bonus game is carried out regardless of a result of another first bonus game.

The first bonus game is also carried out regardless of a result of the second bonus game by means of satisfying specific requirements, such as random numbers to be determined by the program assume predetermined numbers. Contents of the first bonus game are as follows. Specifically, when the specific requirements are satisfied, the first bonus game is started. A pierrot character (or a clown character) riding on a unicycle appears from a lower portion of the main display 20 before spinning of the reels. After stoppage of the reels, the pierrot character (or clown character) selects anyone from the symbols. According to the kind of the thus-selected symbol, contents of a bonus game to be afforded to the player are determined.

FIG. 6 shows a table 75 showing a relationship between the types of symbols to be selected in the first game bonus and contents of a bonus game to be afforded to the player. The table 75 is stored in the main memory 52. In the table 75, correspondence exists between ticket symbols indicated by symbol J and the second bonus game. In other words, when ticket symbols are selected in the first bonus game, the second bonus game is executed.

The above-mentioned respective bonus games are controlled by means of synergistic operation among the CPU 51, the main memory 52, the image processing circuit 53, all belonging to the controller 50, and the main display 20.

FIG. 7 shows a symbol table 64 representing symbols to be displayed on the respective reels. Information about the symbol table 64 is stored in the main memory 52. Letters provided in the table represent the types provided in FIG. 5. For instance, ticket symbols (denoted by J) appear in the third, thirteenth, and twenty-third frames on the second reel, the third, thirteenth, and twenty-third frames on the third reel, and the third frame on the fourth reel. Images are formed in the display area on the main display 20 as if symbols were printed on the reels, in the sequence shown in the symbol table 64.

Figure 8:
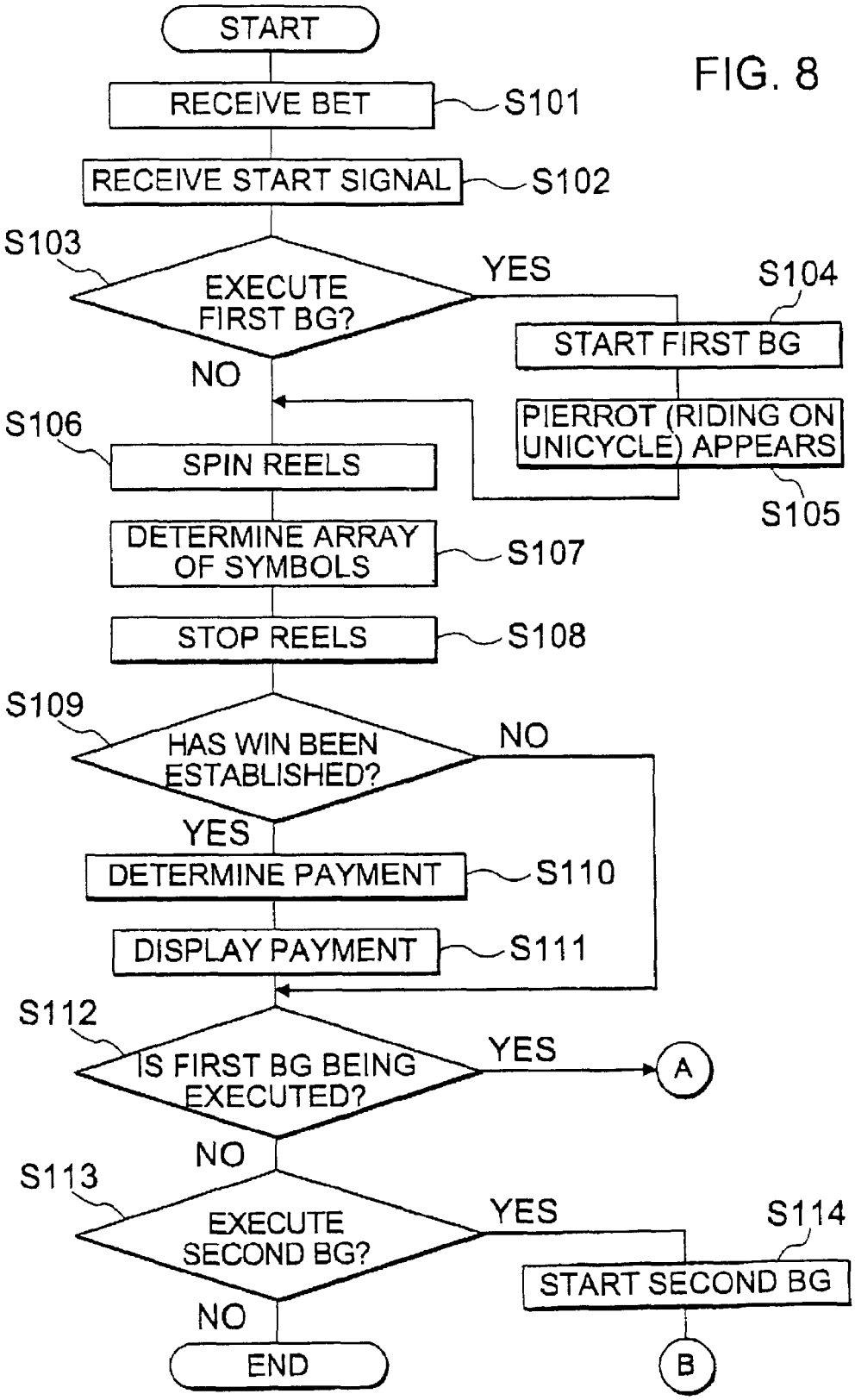
FIG. 8 is a flow chart showing a method for controlling the slot machine.
Figure 9:
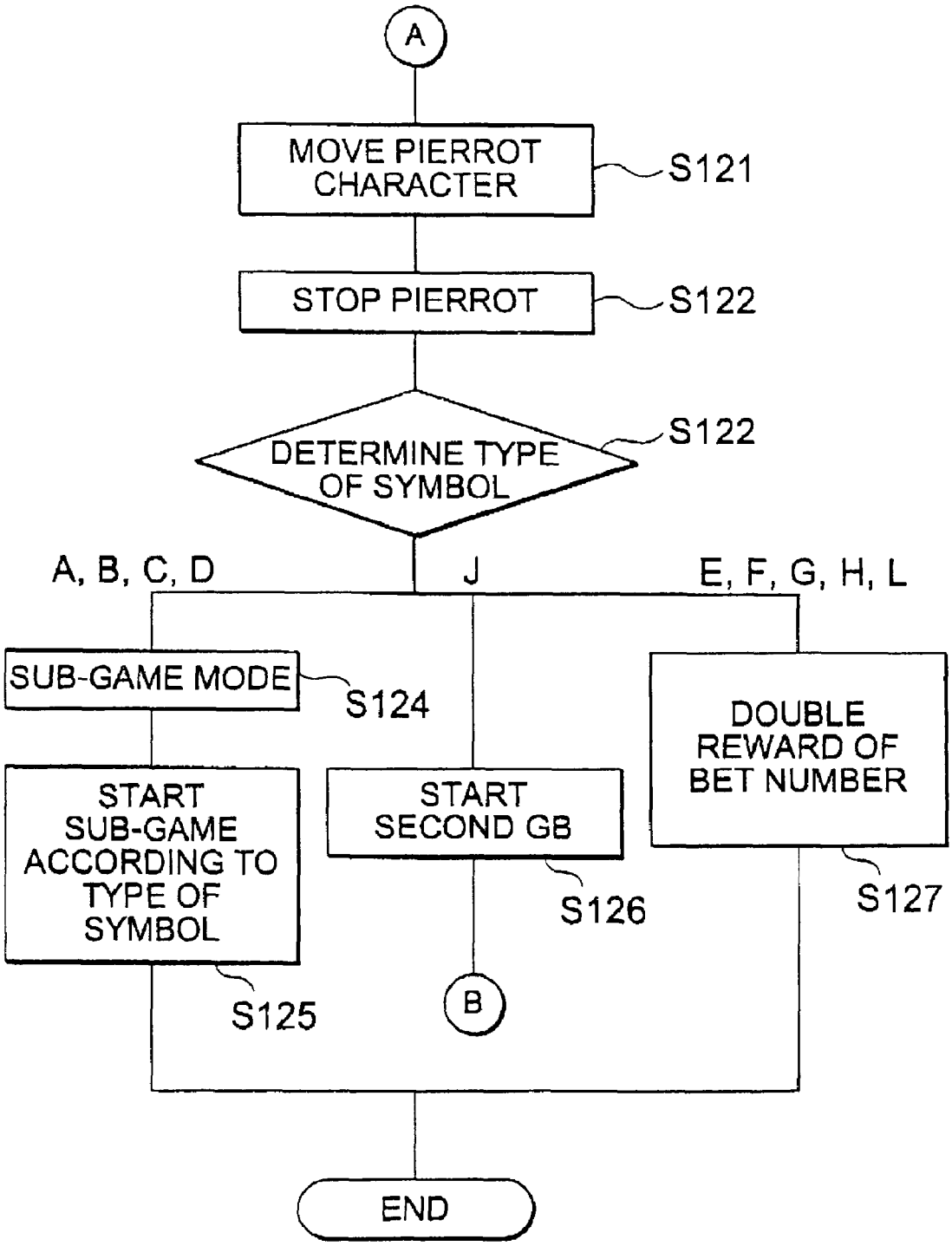
FIG. 9 is a flowchart showing a method of controlling the slot machine in which the first bonus game is proceeding.

By reference to the flowcharts shown in FIGS. 8 through 10, a method of controlling the slot machine of this embodiment will be described.

First, by reference to FIG. 8, the flow of a basic slot game will be described while mention is made of a determination as to whether to execute a bonus game. When the slot machine 10 is activated, the CPU 51 accesses the main memory 52, thereby transferring to the image processing circuit 53 information about a basic screen of a slot game, such as frames defining a display area or the PAY TABLE key 61. The image processing circuit 53 temporarily stores the information into the video RAM and then displays the information on the main display 20. As a result, the slot machine 10 enters a state in which a player can play slot games. The following processing is performed as a result of a module of the program stored in the main memory 52 pertaining to a slot game being executed by the CPU 51.

In step 101 (hereinafter a "step" is abbreviated as "S"), the CPU 51 of the controller 50 awaits a betting operation (BET). The BET operation can be performed with remaining credits. The player instructs the BET number (or the number of coins bet) by means of pressing any one of the BET button 25, the MAX BET button 26, and the REPEAT BET button 27.

After the BET operation has been completed, the player presses the start button 24 (S102). Prior to spinning of the reels, the CPU51 renders a determination as to whether to start the first bonus game (a bonus game is abbreviated as "BG" in the flowchart), as determination means. Utilized in rendering the determination are random numbers determined by a program stored in the main memory 52. For instance, random numbers are generated within the range of integers from 1 through 10. When the random number has assumed 1, specific requirements are determined to have been satisfied, whereupon a first bonus game is started.

When in S103 the first bonus game is determined to have been executed, processing proceeds to S104. The first bonus game is executed as a result of the CPU 51 executing a program stored in the main memory 52 serving as execution means.

Figure 11:
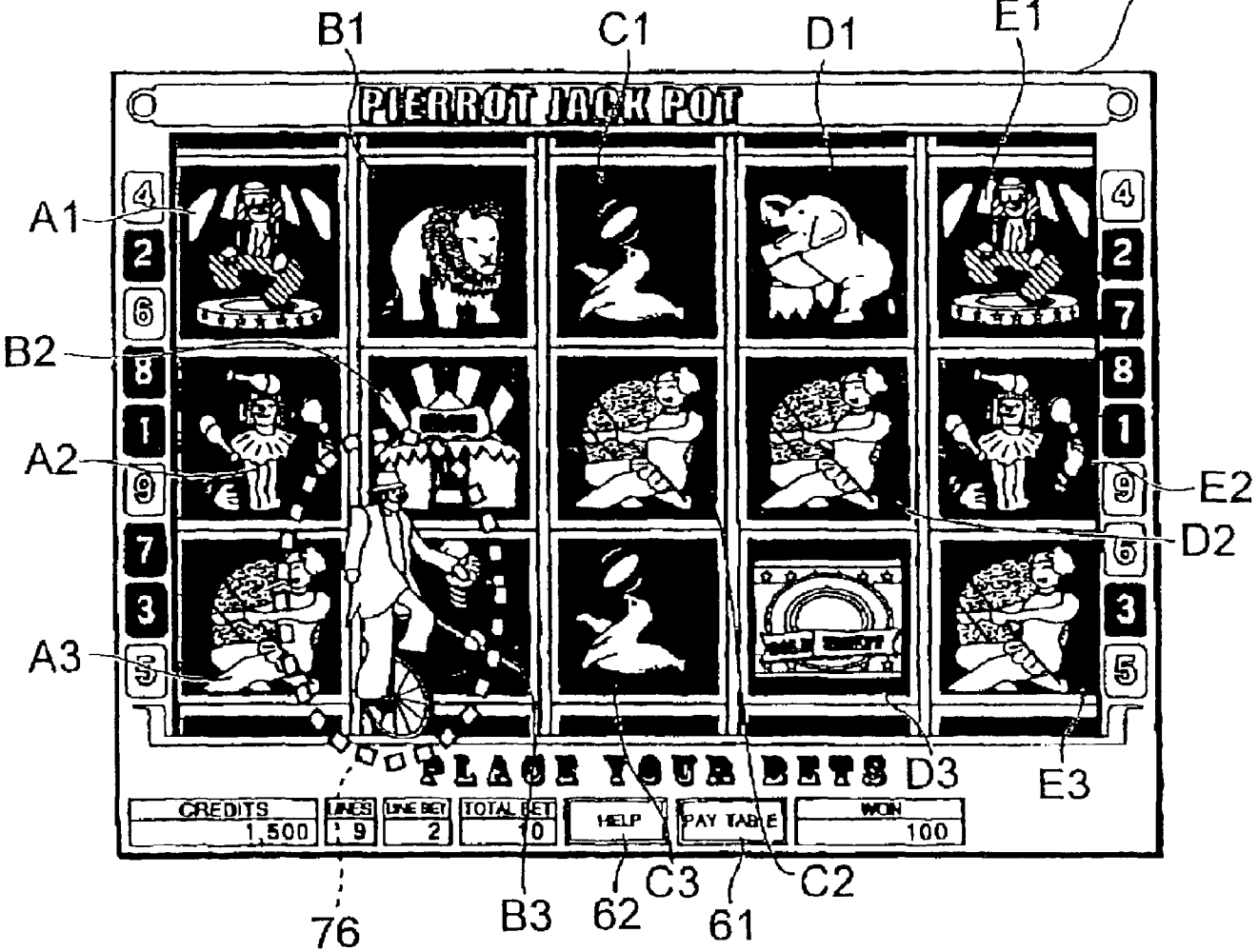
FIG. 11 is a view showing a state in which a pierrot (or a clown) riding on a unicycle appears on the main display.

As shown in FIG. 11, in the first bonus game, the pierrot character 76 riding on a unicycle is caused to appear on the main display 20 before spinning of the reels (S105). The CPU 51 controls the image processing circuit 53, thereby stopping the pierrot character 76 at a position located below any one of the five columns. FIG. 11 shows that the pierrot character is stopped at a display area B3.

After the pierrot character 76 has been stopped in S105 or the first bonus game is determined not to be executed in S103, the reels start spinning on the main display 20 (S106). More specifically, upon receipt a start signal from the start button 24, the CPU 51 controls the image processing circuit 53, thereby causing the image processing circuit to perform image processing as if real reels were spinning. Here, when the player has pressed the MAX BET button 26 or the REPEAT BET button 27, the reels start spinning without involvement of pressing of the start button 24.

After the reels have started spinning, the CPU 51 generates random numbers in accordance with the program stored in the main memory 52. Stop positions of the respective reels, that is, symbols to be displayed in respective display areas, are determined in accordance with the numbers (S107). Sampling operation based on such random numbers may be performed at arbitrary timings. For instance, sampling operation may be performed when the start button 24 is pressed, or sampling operation may be performed again each time the BET button is pressed.

Next, the CPU 51 controls the image processing circuit 53, thereby stopping the reels on the main display 20 (S108).

At this time, settings may be effected such that at least one symbol appears in each of the display areas. Alternatively, settings may be effected such that, depending on random numbers, no symbols appear or only a portion of symbols appears. In this embodiment, at least one symbol is assumed to appear in each of the display areas.

After the reels have come to a standstill, the CPU 51 determines a win (S109). Here, occurrence of a win can be determined at a point in time when the arrangement of symbols has been determined in step S107. Hence, processing pertaining to step S109 may be performed before processing pertaining to S108 is performed. If the symbols have established an arrangement for a win, the CPU 51 determines a payment to be afforded to the player on the basis of the pay table 63 stored in the main memory 52 (S110). The amount of payment is displayed in the column of "WON" on the main display 20 (S111). If no win has been established in S109, processing proceeds to S112 while bypassing S110 and S111.

In S112, the CPU 51 determines whether or not the first bonus game is executed. If in step S103 the first bonus game is determined to be executed, the CPU 51 executes processing pertaining to step S121 shown in FIG. 9. In S121, the CPU 51 controls the image processing circuit 53, thereby moving in the vertical direction the pierrot character 76 stopped in the display area B3.

Figure 12:
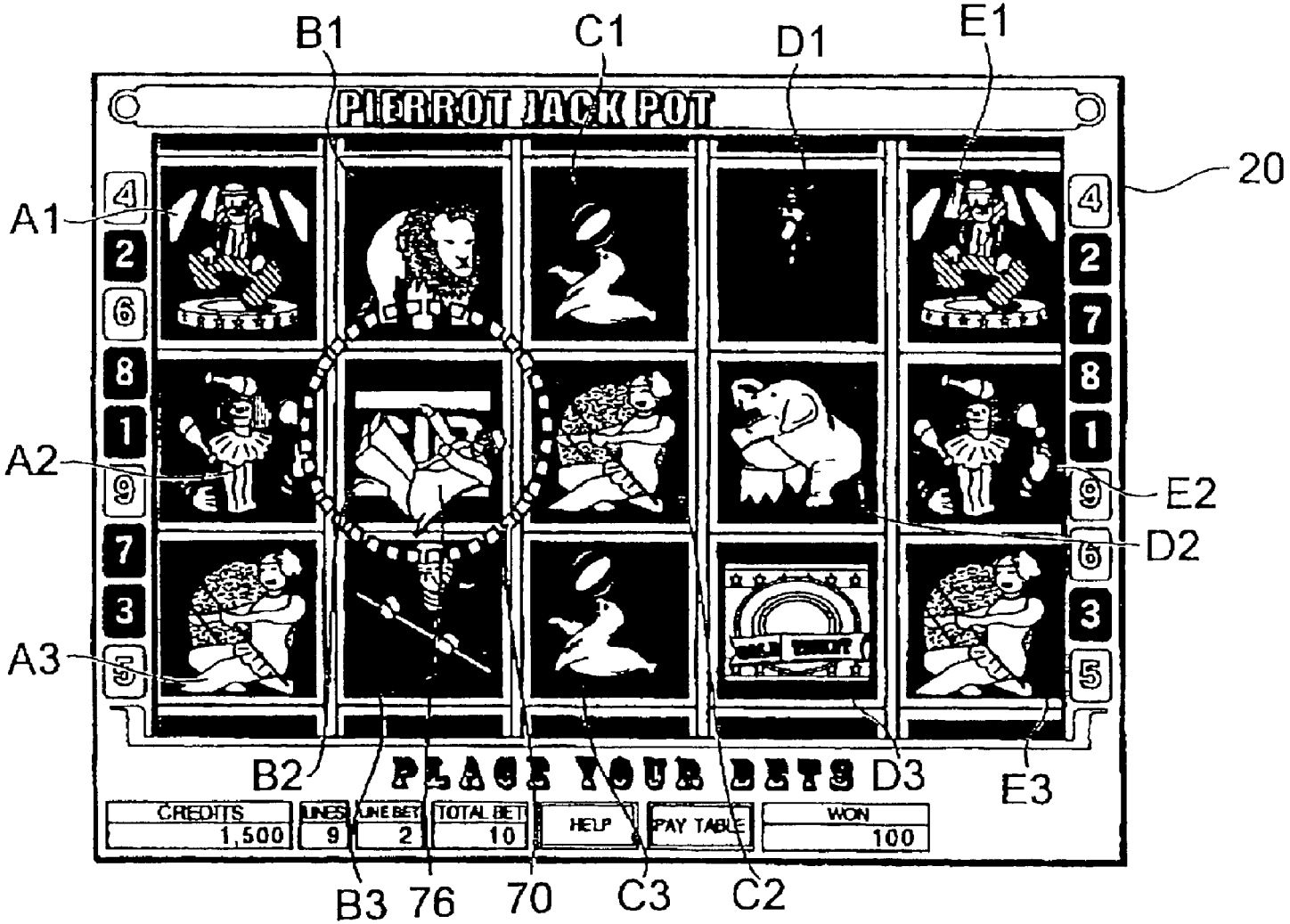
FIG. 12 is a view showing a state in which one symbol (ticket symbol) has been selected as a result of the pierrot character (or the clown character) tumbling during the first bonus game.

As shown in FIG. 12, after lapse of a predetermined period of time, the pierrot character 76 tumbles over in any of the display areas B1, B2, and B3, thereby stopping movement of the pierrot character (S122). Here, the pierrot character 76 has tumbled over in the display area B2.

Next, the CPU 51 determines the type of the symbol selected as a result of the pierrot character 76 having tumbled in S122 (S123). The display area where the pierrot character 76 is to tumble can be determined by, e.g., random numbers. Such a determination can be made in any step prior to S121. In this case, the type of the selected symbol may be determined in any step prior to S121.

By reference to the table 75 shown in FIG. 6, any of execution of a sub-game, execution of a second bonus game, and a payment of double BET number (or double number of tokens bet) is afforded to the player according to the type of the symbol determined in S123. More specifically, as can be seen from the table 75, when any one has been selected from the top four symbols; that is, PIERROT (A), GAL (B), LION (C), and ELEPHANT (D), processing proceeds to S124, where a game status enters a sub-game mode. When any one has been selected from the lesser five symbols; that is, SEAL (E), ROPE (F), CLUB (G), TENT (H), and BEAR (L), processing proceeds to S127, where a payment double the total BET number (or the total number of tokens bet) in the slot game is paid to the player as a bonus. Moreover, when the ticket symbol (J) has been selected, processing proceeds to S126, where a second bonus game is executed.

For example, when in S123 an elephant symbol (display area D1) is determined to have been selected, the CPU 51 ascertains playing of an "elephant's quoits game," which is a sub-game, on the basis of the table 75. Then, a program of "elephant's quoits game" stored in the second memory 55 of the controller 50 is executed (S125).

The sub-game is to be caused to proceed on the second display 30. Contents of a display on the second display 30 are controlled by the image processing circuit 56. In this way, as a result of a sub-game being executed on the display differing from that on which the bonus game is to be executed, the player can have a feeling of initiation of a new bonus game, thereby enhancing entertainment value.

At the time of start of the "elephant's quoits game," image processing is effected such that the pierrot character 66 that has selected the elephant symbol on the main display 20 is blown away to the second display 20 by the elephant. The pierrot character that has been blown to the second display 30 throws rings at the trunk of another elephant having emerged on the screen. A reward is paid to the player in accordance with the number of the rings landing on the trunk. When this sub-game is executed, a payment has been determined in advance by random numbers in accordance with the program stored in the second memory 55, and then image processing is performed such that the pierrot throws rings.

Other sub-games will now be described briefly. For instance, in a showdown game to be executed when the pierrot symbol is selected, two pierrots appear, and the player selects one of them. If the pierrot selected by the player has achieved a win against the other pierrot for tightrope walking and quoits, a predetermined reward is afforded to the player. At the time of selection of a pierrot, the player may utilize the select buttons 31, 32. Alternatively, a touch sensor may be provided on the second display 30 so that the player selects a pierrot by means of touching an image of pierrot appearing on the screen.

Figure 10:
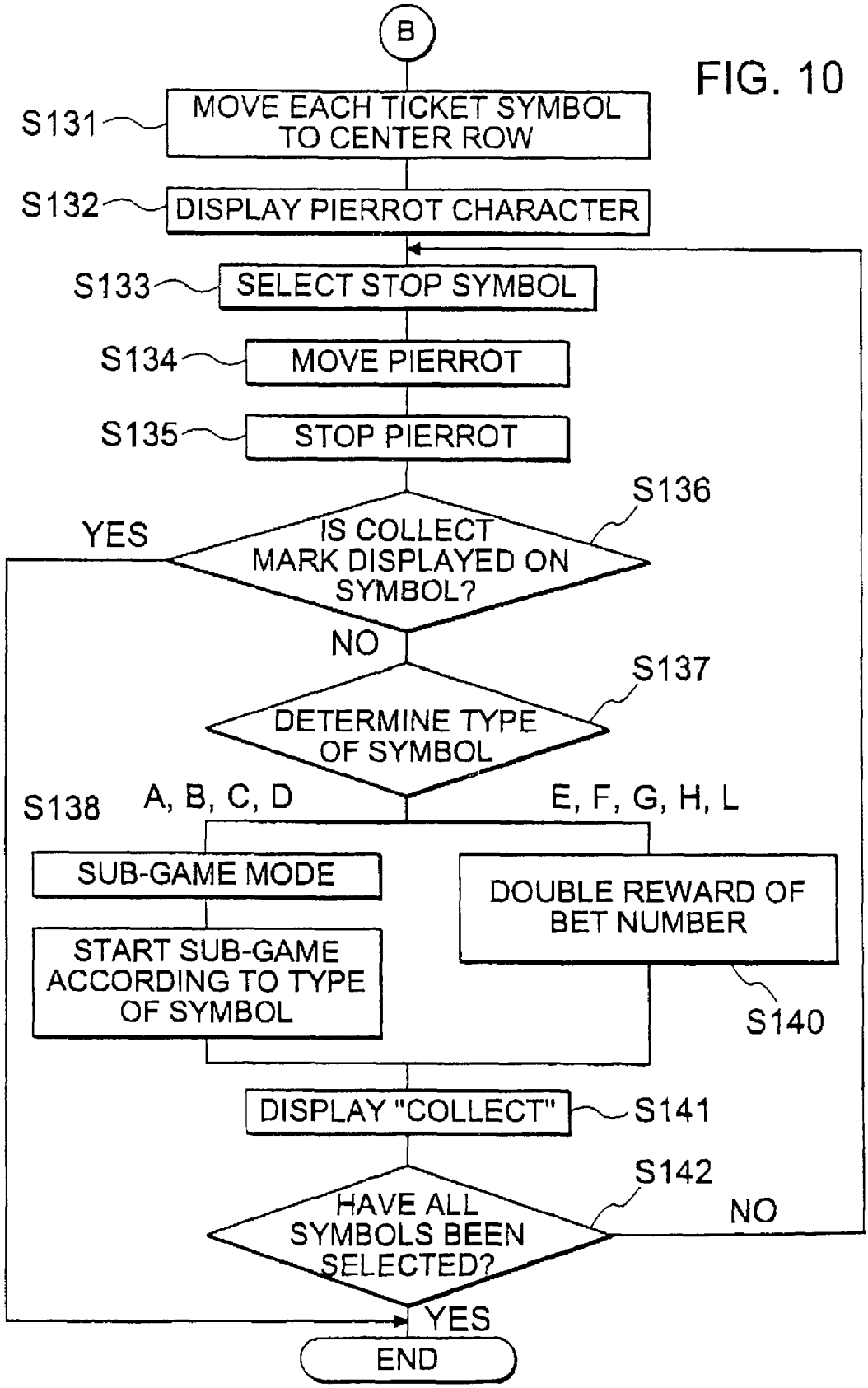
FIG. 10 is a flowchart showing the method of controlling the slot machine in which a second bonus game is proceeding.

As shown in FIG. 12, when a ticket symbol 70 is selected as a result of a pierrot character having tumbled, processing proceeds from S126 to S131 shown in FIG. 10, where a second bonus game is to be executed. Details of this game will be described later. Alternatively, settings may be made such that processing proceeds to S113 shown in FIG. 8 after completion of the first bonus game.

Turning back to FIG. 8, the basic flow will be described. When in S112 the first bonus game is determined as being executed, processing shown in FIG. 9 is performed. In contrast, when in S112 the first bonus game is determined not being executed, processing proceeds to S113. In S113, the CPU 51 determines whether to play a second bonus game.

Requirements for executing the second bonus game are that ticket symbols are displayed on each of the second, third, and fourth columns. A determination as to whether or not ticket symbols are to be displayed on each of the second, third, and fourth columns is made by utilization of the program stored in the main memory 52. For instance, random numbers are generated within the range of integrals from 1 to 10. When the random number has assumed 2, a second bonus game is started as the specific requirements having been satisfied. In this embodiment, even when the ticket symbols appearing on the second, third, and fourth columns are displayed in different rows, processing proceeds to the second bonus game. This determination can be made whenever the arrangement of symbols has been determined in S107.

If in S113 ticket symbols are not displayed on all the second, third, and fourth reels, the slot game is terminated, and a message; e.g., "GAME OVER," appears on the main display.

Figure 13:
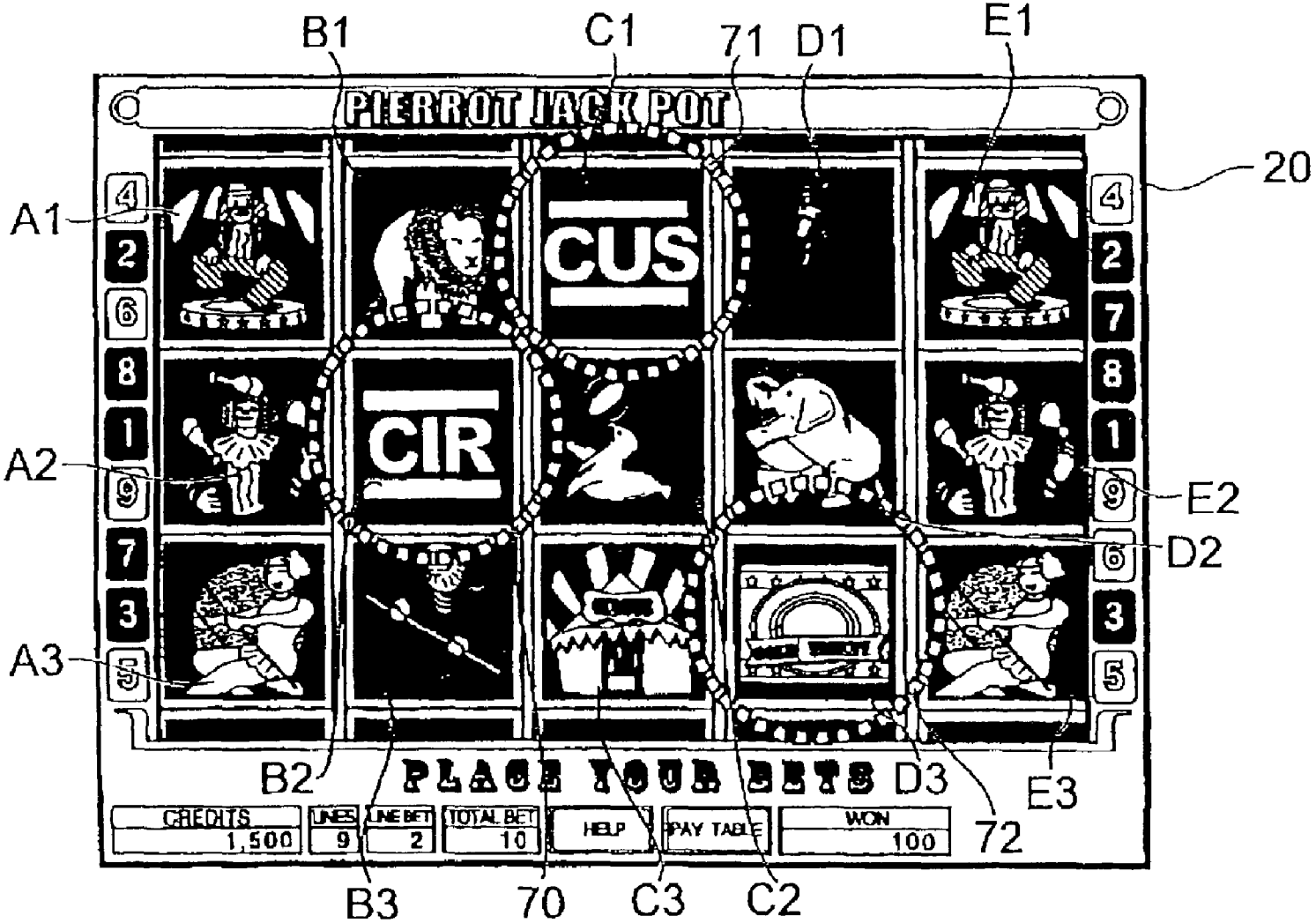
FIG. 13 is a view showing a state in which requirements or a condition for starting a second bonus game has been satisfied, wherein three bonus symbols (ticket symbols) appear on the main display.

As shown in FIG. 13, if the ticket symbols are displayed on each of the second, third, and fourth reels, processing proceeds to S114, where the CPU 51, serving as execution means, starts the second bonus game. In the drawing, the ticket symbols 70, 71, and 72, which are ticket symbols, are displayed in display areas B2, C1, and D3 (the ticket symbols are encircled with broken lines). As mentioned above, alignment of ticket symbols in display areas from left to right is not a requirement, a bonus game is started so long as ticket symbols are aligned on columns excluding the rows located at both ends of the display area, thereby affording newness to the player.

A second bonus game will now be described by reference to the flowchart shown in FIG. 10. Here, the second bonus game is executed by means of the CPU 51 executing a program stored in the main memory 52.

Figure 14:
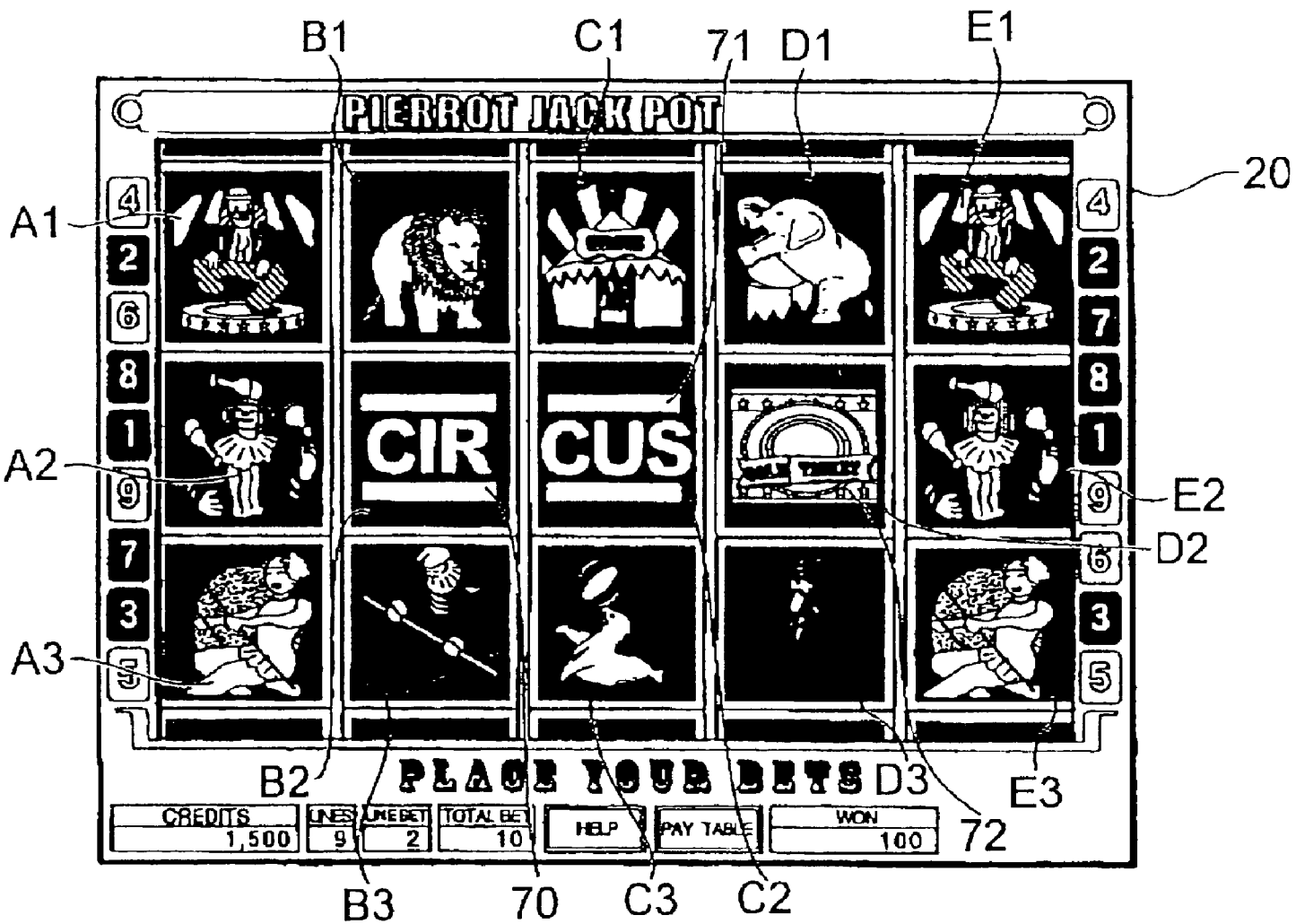
FIG. 14 is a view showing a state in which three bonus symbols are moved to the center line during the second bonus game.

As shown in FIG. 14, the CPU 51 controls the image processing circuit 53, thereby moving the ticket symbols 70, 71, and 72 to the center line of the three rows, namely, areas B2, C2, and D2. In short, the ticket symbols 70, 71, and 72 are enclosed with one display area on either side.

Figure 15:
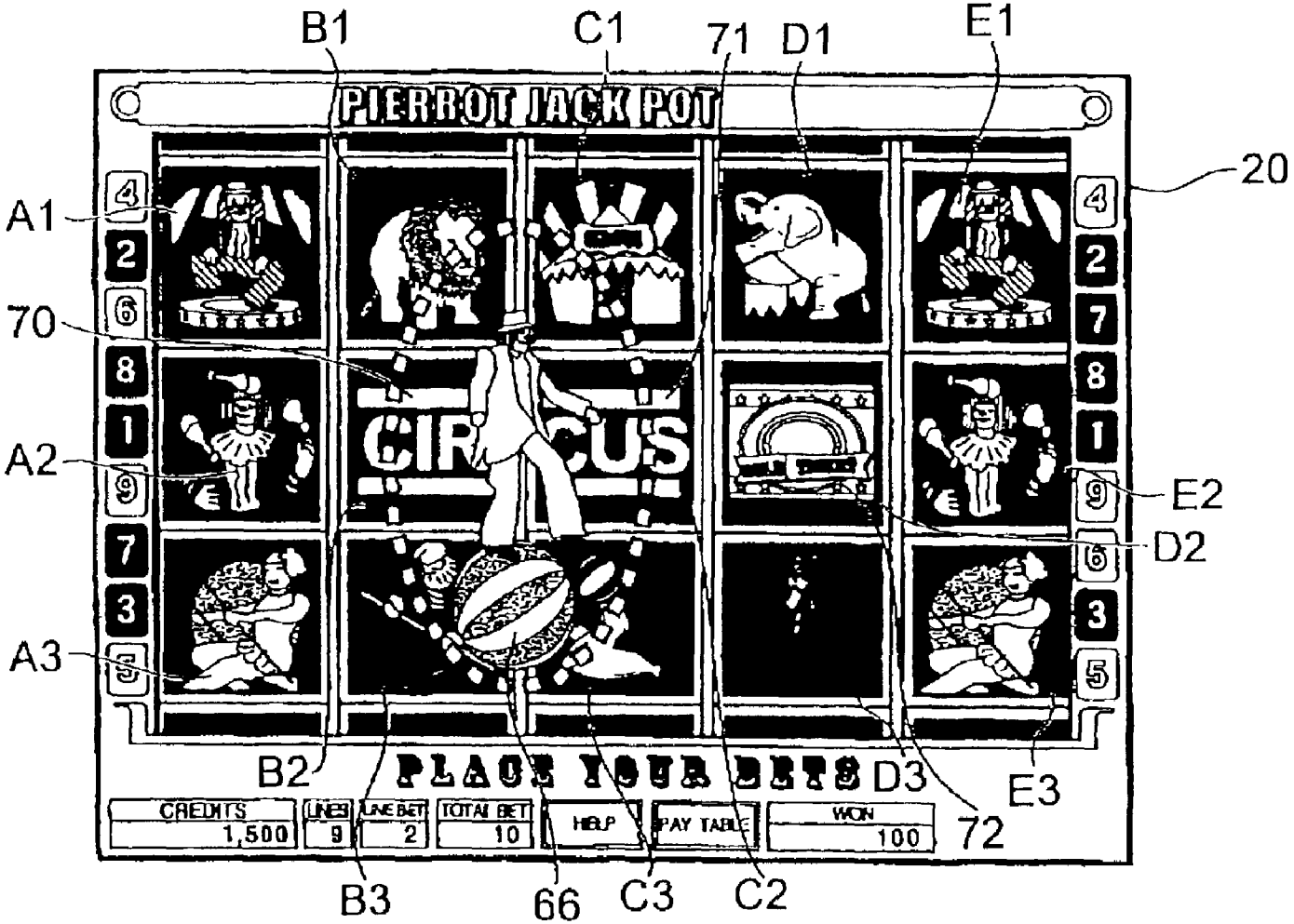
FIG. 15 is a view showing a state in which a pierrot character (or a clown character) has appeared in the second bonus game.

The CPU 51 controls the image processing circuit 53 in S132. As shown in FIG. 15, the pierrot character 66 riding on a large pole is displayed on the main display 20. Image information about the pierrot character 66 is stored in the main memory 52 beforehand.

Next, the CPU 51 determines a display area where the pierrot character 66 to be moved is to be stopped, on the basis of the random numbers determined by the program stored in the main memory 52 (S133). Here, the display area D1 is assumed to have been selected. As mentioned above, in this embodiment, at least one symbol is assumed to inevitably appear in each of the display areas. In other words, symbols at which the pierrot character 68 is to stop are determined in S133.

Figure 16:
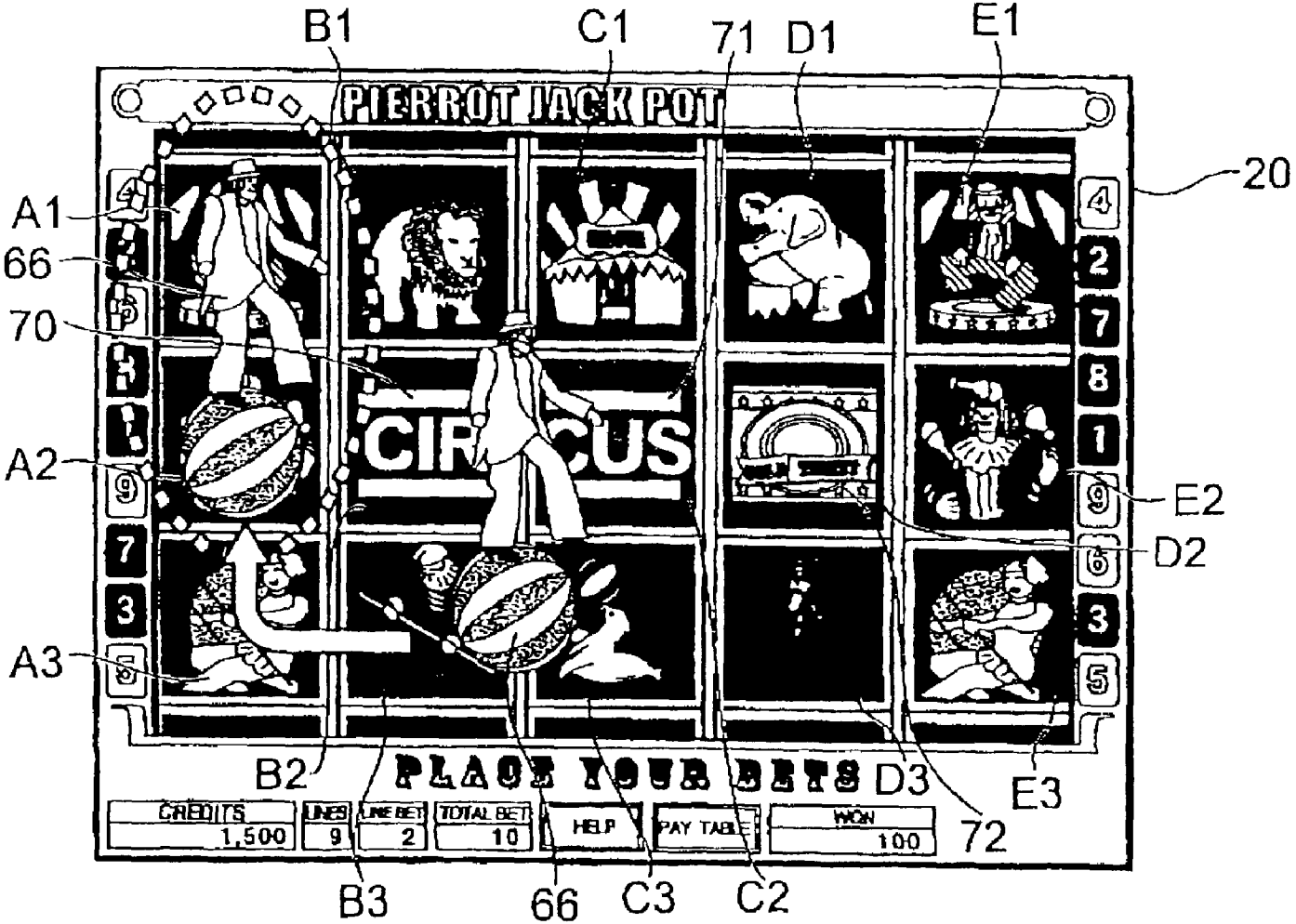
FIG. 16 is a view showing a state in which the pierrot character (or the clown character) is moving in the second bonus game.

As shown in FIG. 16, the image processing circuit 53 moves the pierrot character 66 on the display areas surrounding the three thicket symbols 70, 71, and 72 appearing in the center display areas B2, C2, and D2 under control of the CPU 51 (S134). Here, the pierrot character may be moved in either a clockwise or counter clockwise direction, or in both directions alternately. At this time, the pierrot character 66 moves over the top row, the bottom row, the leftmost column, and the rightmost column from among a plurality of display areas. In short, three bonus symbols are aligned on the center three reels from among five reels, with the reels at both ends being excluded, whereby a path for movement of the pierrot character 66 around the bonus symbols is formed.

Figure 17:
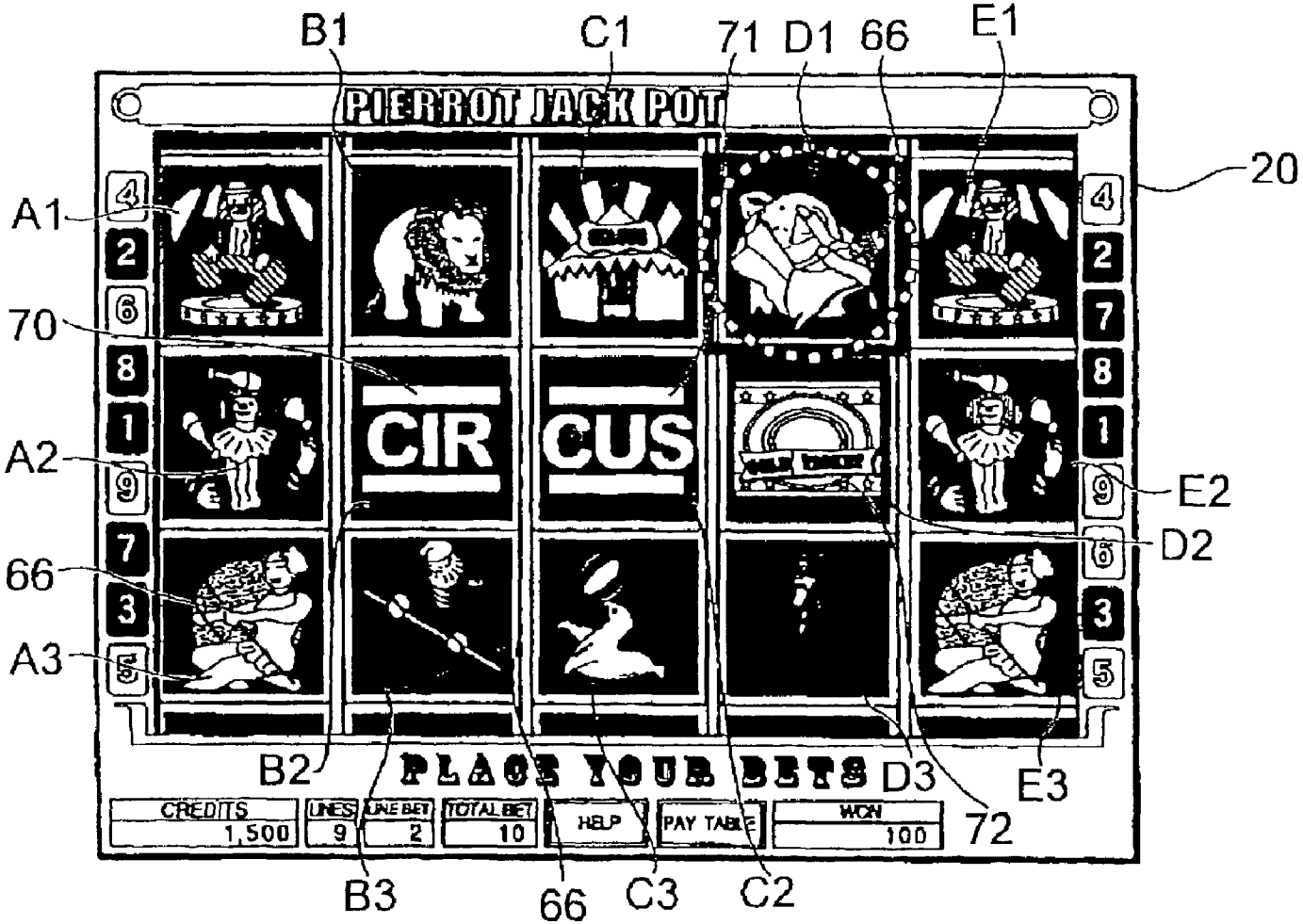
FIG. 17 is a view showing a state in which the pierrot character (or the clown character) has tumbled, thereby selecting an elephant symbol.

As shown in FIG. 17, the CPU 51 controls the image processing circuit 53, thereby causing the pierrot character 66 to tumble on the symbol selected in S133, thereby stopping movement of the pierrot character 66 (S135). In this embodiment, the pierrot 66 operates to tumble, thereby enabling the player to ascertain selection of the symbol located in the display area. In this embodiment, the elephant symbol appearing in the display area D1 is selected. In this embodiment, a symbol is selected by means of an action; that is, tumbling of the pierrot. However, selection of a symbol may be indicated by another action. For instance, the pierrot character may simply stop at a symbol or turn a somersault.

In S136, the CPU 51 determines whether or not a mark "COLLECT" is displayed on the symbol selected by tumbling of the pierrot. The "COLLECT" mark is to be displayed on the symbol selected as a result of tumbling of the pierrot. This symbol is not displayed on any symbol at the beginning of a bonus game.

When no COLLECT mark is displayed on the selected symbol, processing proceeds to S137, where the type of the symbol is determined. The player is awarded a bonus corresponding to the type of the symbol. At this time, the CPU 51 determines details of a bonus on the basis of the table 65 shown in FIG. 18.

The table 65 shown in FIG. 18 shows a correlation between the types of symbols to be selected as a result of tumbling of the pierrot character 66 and details of a bonus afforded to the player. Information about the correlation is stored in the ROM area of the main memory 52. As can be seen from the table 65, when any one of the top four symbols; that is, PIERROT (A), GAL (B), LION (C), and ELEPHANT (D) is selected, processing proceeds to step S138, where the game status enters a sub-game mode. In contrast, when any one has been selected from the lesser five symbols; that is, SEAL (E), ROPE (F), CLUB (G), TENT (H), and BEAR (L), processing proceeds to S140, where a payment of double BET number (or double of the total number of tokens bet) in the slot game is paid to the player as a bonus.

If the elephant symbol (display area D1) is ascertained to have been selected, the CPU 51 checks execution of an "elephant's quoits game" on the basis of the table 65, and then executes a program of "elephant's quoits game" stored in the second memory 55 of the controller 50 (S139).

Individual sub-games to be executed as the second bonus game are identical with those to be executed in the first bonus game.

Figure 19:
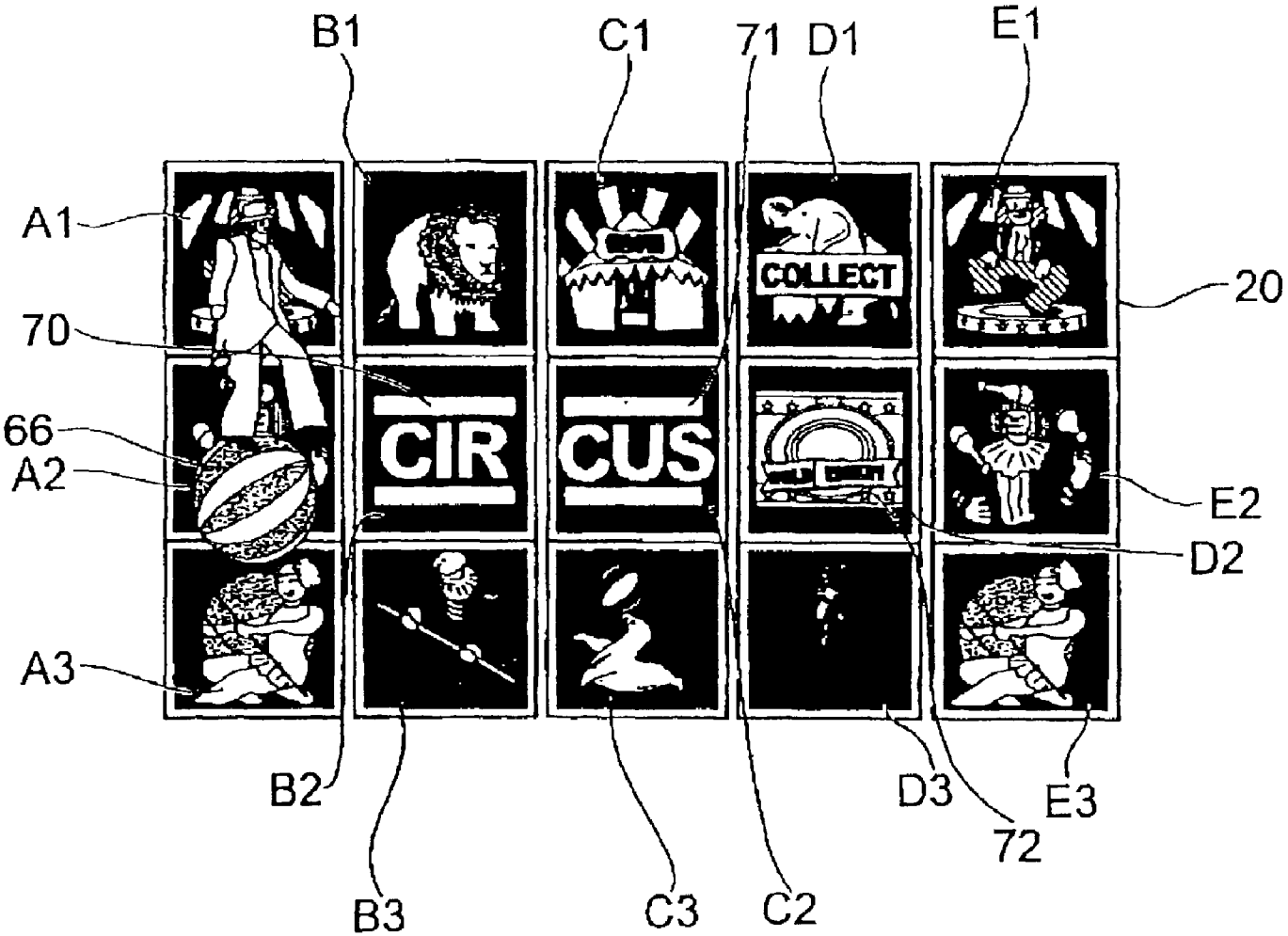
FIG. 19 is a view showing a state in which a COLLECT mark appears on the selected elephant symbol in the second game.

After a bonus, such as provision of a sub-game or payment of coins, has been awarded to the player, the CPU 51 controls the image processing circuit 53 in S141, thereby displaying, on the symbol (elephant symbol) selected on the main display 20, a COLLECT mark indicating that the symbol has already been selected as a result of tumbling of the pierrot character 66 (see FIG. 19). Image information about the COLLECT mark is stored in the ROM area of the second memory 55.

Next, the CPU 51 determines whether or not all the symbols situated around the ticket symbols 70, 71, and 72 have been selected (S142). If all the symbols have been selected, the bonus game is terminated, and a message to the effect is reported to the player in the form of an indication on the display. In contrast, if not all the symbols have been selected, processing returns to S133. Through processing pertaining to steps S133 to S135, the pierrot character 66 is moved again and caused to tumble, thereby selecting any one from the symbols. In short, the player is again given a chance of acquiring a bonus. In this way, a plurality of chances of acquiring a bonus are afforded to the player over several times, thereby enhancing the player's interest in the slot machine 10. Here, at the time of selection of a symbol to be performed in S133, the symbols that have already been selected also become candidates for sampling.

If no COLLECT mark is displayed on the selected symbol, a bonus corresponding to the type of the symbol is awarded to the player in any step subsequent to S137. In contrast, if the COLLECT mark is displayed on the selected symbol (e.g., the elephant symbol appearing in the display area D1 shown in FIG. 19 is selected), the bonus game is terminated, and termination of the bonus game is reported to the player. In this way, settings are made such that, when the display area on which the COLLECT mark has been displayed is again selected by the character, the bonus game is terminated. As a result, the player desires that the pierrot character 66 will not tumble in the display area having the COLLECT mark displayed thereon, thus rendering the bonus game more thrilling.

When no COLLECT mark is displayed on the selected symbol and a predetermined payment has already been awarded to the player, the COLLECT mark appears on the selected symbol in S141.

Figure 20:
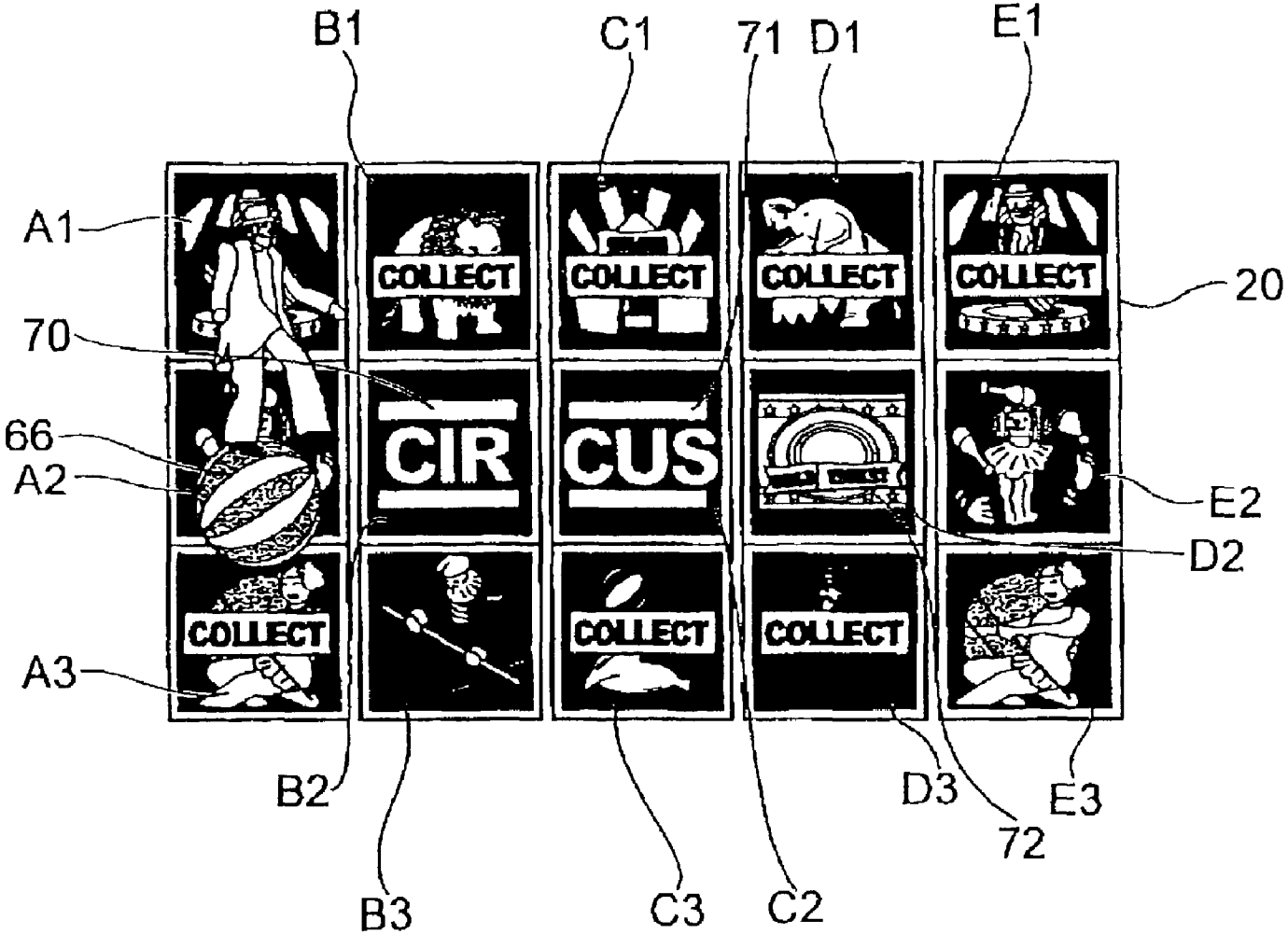
FIG. 20 is a view showing a state in which COLLECT marks appear on a plurality of symbols in the second game.

The pierrot character 79 continues selecting a symbol until the bonus game is terminated as a result of all the symbols have been selected or until the bonus game is terminated as a result of selection of the COLLECT mark, whereby the player is given chances to acquire a bonus. As shown in FIG. 20, as bonuses are continuously given, the number of symbols having the COLLECT mark displayed thereon increases. Hence, the probability of the player being able to acquire a bonus becomes gradually smaller, thereby enhancing the feeling of a thrill.

The method of controlling the slat machine 10 of this embodiment has been described thus far. Here, by reference to FIG. 21, the flow of a basic slot game and individual bonus games to be performed in the slot machine 10 will be described briefly.

Figure 21:
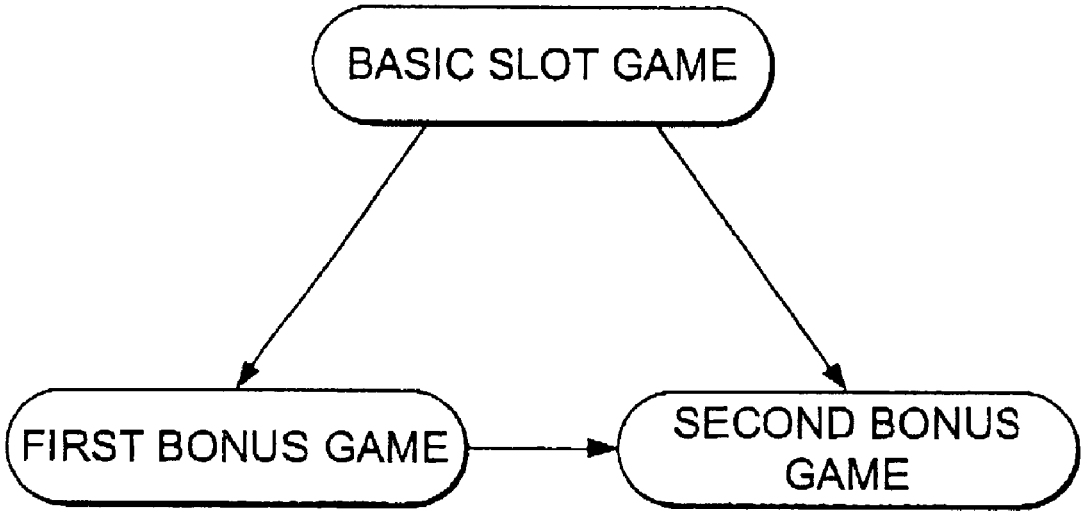
FIG. 21 is a view showing a relationship among the basic slot game, the first bonus game, and the second bonus game.

As shown in FIG. 21, the slot machine 10 has the first and second bonus games added to a basic slot game. So long as specific requirements, such as acquisition of a predetermined random number, have been satisfied, each of the bonus games can be executed without regard to a result of another bonus game. Further, even when a specific result has been accomplished through the first bonus game; specifically, even when the pierrot character has selected a ticket symbol in the first game, the second bonus game is executed. In other words, in this embodiment, the player can proceeds from the basic slot game to the first and second bonus games. Moreover, there is adopted a type of development of a game, such as a development in which the player can proceed even from the first bonus game to the second bonus game, thereby enhancing entertainment value.

As a result of processing being caused to proceed to the second game in accordance with the type of the symbol selected in the first bonus game, the player can enjoy which of the symbols is selected in the first game, thus enhancing the entertainment value.

In this embodiment, even when a ticket symbol appears on any row of the second, third, and fourth reels, the second bonus game is arranged to be started. However, it may be the case that processing proceeds to the second bonus game only when the ticket symbols provided on the respective reels are displayed in the center row (i.e., only when the ticket symbols are displayed in the display areas B2, C2, and D2). As in the case of the former case, if the gaming apparatus is constructed such that a bonus game is started when a bonus symbol appears in any row, the player has a feeling of a having high probability of being able to start a bonus game, thus attracting the player's interest in the slot machine 10.

By reference to FIGS. 22 and 23, a preferred embodiment of a program and a computer-readable recording medium having the program recorded thereon will be described.

Figure 22:
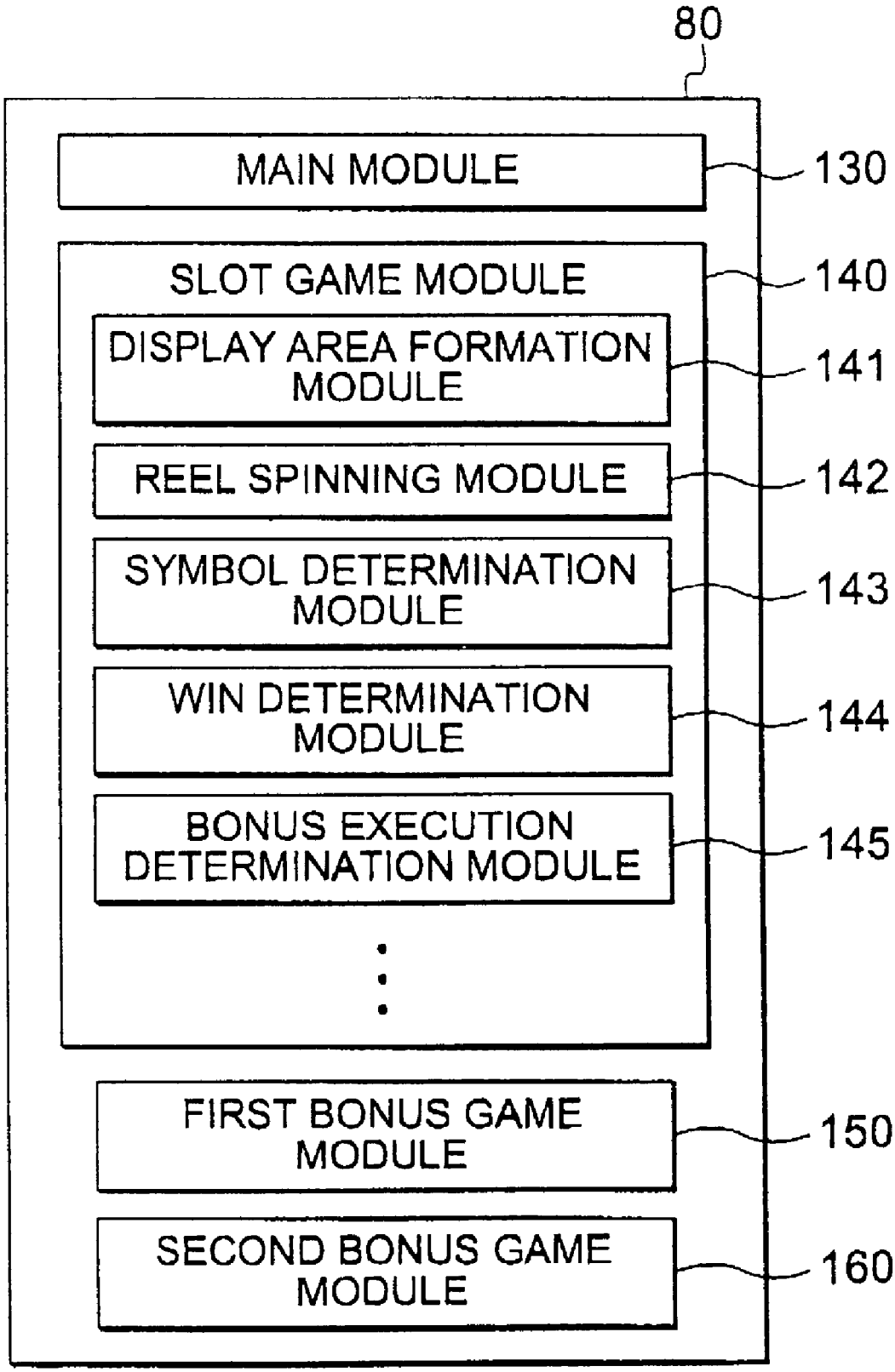
FIG. 22 is a block diagram showing individual modules of a program according to the present invention.
Figure 23:
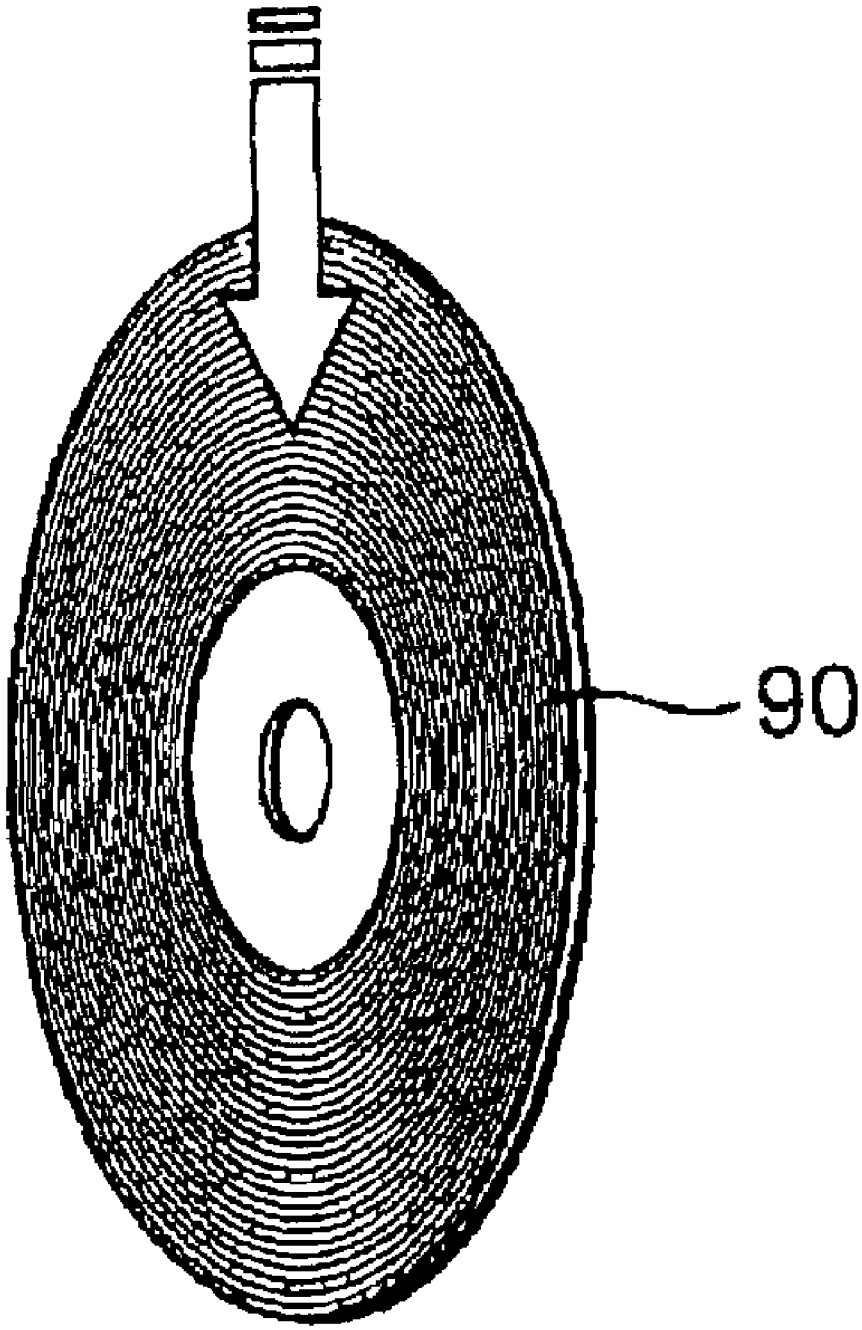
FIG. 23 is a view showing a computer-readable recording medium (CD-ROM) having the program shown in FIG. 22 recorded thereon.

FIG. 22 is a view showing individual modules of a program 80 of this embodiment. FIG. 23 is a view showing a CD-ROM (recording medium) 90 having the program 80 written thereon.

The program 80 comprises a main module 130 for controlling processing in a centralized manner; a slot game module 140 pertaining to processing of the slot game; a first bonus game module 150 pertaining to processing of a first bonus game; and a second bonus game module 160 pertaining to processing of a second bonus game.

Moreover, the slot game module 140 includes at least a display area formation module 141; a reel spinning module 142; a symbol determination module 143; a determination module 144; and a bonus execution determination module 145.

The display are a formation module 141 forms, on the display, a display area into which symbols are to be displayed. The reel spinning module 142 rotationally displays reels on the display. The symbol determination module 143 determines symbols to be displayed in the respective display areas on the basis of random numbers. The win determination module 144 determines occurrence of a win on the basis of arrangement of the symbols displayed in the respective display areas. The bonus execution determination module 145 determines whether the first bonus game or the second bonus game is to be executed, on the basis of the random numbers. As a result of the respective modules being executed by a computer, processing pertaining to S101, S102, and S106 to S113 shown in FIG. 8 can be implemented in the slot machine 10.

The first bonus module 150 is for executing the first bonus game. As a result of the computer executing the modules, processing pertaining to S104 and S105 shown in FIG. 8 and S121 and S127 shown in FIG. 9 in the slot machine 10 is executed. Further, the second bonus game module 160 is for executing the second bonus game. As a result of the modules being executed by the computer, processing pertaining to S114 shown in FIG. 8 and processing pertaining to S131 through S142 shown in FIG. 10 can be implemented in the slot machine 10.

As mentioned above, when the program 80 which is acquired by way of a communication network, such as the Internet, or the program 80 recorded on the CD-ROM 90 is installed in any of various computers, such as a personal computer or a portable information terminal (e.g., a personal digital assistance: PDA), a game analogous to that provided on the slot machine 1 can be realized. In other words, processing can proceed from a basic slot game to first and second bonus games. Processing further proceeds even from the first bonus game to the second bonus game. Thus, there is embodied a game involving a new manner of development.

Here, image data required for implementing a game, such as symbols or characters, a pay table, or a correspondence table pertaining to symbols to be selected in a bonus game and details of bonuses may have been incorporated into the program 80 in advance. Alternatively, data may be installed into a computer from a source other than a program. Further, the program 80 may be equipped with any modules required for effecting processing to be performed by the slot machine 10, other than the modules shown in FIG. 22.

The recording medium may be embodied by any type of medium, so long as the medium enables a computer to read written data. For instance, the medium may correspond to any of a magnetic disk such as an FD, an optical disk such as a DVD, a semiconductor storage device, or a like device.

The invention conceived by the inventor has been described specifically by reference to the embodiments. However, the invention is not limited to the embodiments. For instance, the invention is not limited to proceeding of a game from the first bonus game to the second bonus game. In contrast, a game may be arranged to as to be able to proceed from the second bonus game to the first bonus game. Moreover, the number of bonus games may be increased to three or more.

The display area for symbols is not limited to a 3-by-5 array and can be subjected to design modifications, as required. Further, vertical symbols in respective display areas may spin independently of each other rather than spin-type reels being displayed. Moreover, bonus symbols or characters which move across a display during a bonus game are not limited to those described above but may be subjected to various alterations.

Sampling of symbols to be displayed in the display areas may be performed not by utilization of random numbers obtained by a program but on the basis of random numbers generated by a random number generator.

In addition, a controller for a main display and another controller for a second display may be provided separately. Alternatively, a CPU may be provided for a game to be displayed on respective displays. The main display and the second display may be any type of display, such as a CRT, a plasma display, or an organic EL display.

The gaming apparatus of the invention is not limited to the slot machine. For instance, the slot game may be executed on, e.g., a liquid-crystal screen of a pachinko machine. Alternatively, the game may be executed on a gaming apparatus (e.g., a Pachislo machine) equipped with a stop button to by used by a player for stopping reels.

As has been described, according to the invention, processing can proceed from a basic game to a plurality of bonus games, and processing further proceeds from at least one bonus game to another bonus game. Thus, there is adopted a new type of development of a game, thereby enhancing an entertainment characteristic.

What is claimed is:

1. A gaming apparatus comprising:

a display having a plurality of display areas in which a plurality of types of symbols are variably displayed; and a controller which executes a predetermined program and controls details to be displayed on the display, wherein the controller in accordance with the program proceeds through the following steps:

(a) receiving a bet by a player, deciding a symbol, from among the plurality of symbols, to be displayed in each of the display areas, and executing a basic game that decides a prize, based on an arrangement of the symbols displayed in each of the display areas;

(b) executing a first triggering event during said basic game, resulting in a plurality of first bonus games and executing a second triggering event during said plurality of first bonus games resulting in a plurality of second bonus games, in cases in which a predetermined condition is fulfilled during the basic game;

(c) executing one of the first bonus games, among the plurality of first bonus games associated with one predetermined condition among a plurality of predetermined conditions occurring during said basic game with respect to the plurality of first triggering events, in cases in which one of the predetermined conditions is fulfilled, among a plurality of predetermined conditions that are mutually different, with respect to the first triggering event;

(d) executing the second triggering event during said first bonus games, said triggering event associated with another predetermined condition with respect to the first triggering event, in cases in which another predetermined condition is fulfilled, among the plurality of predetermined conditions with respect to the first triggering event;

(e) executing one of the second bonus games, among the plurality of second bonus games associated with the one predetermined condition of said second triggering event, in cases in which one of the predetermined conditions is fulfilled, among a plurality of predetermined conditions that are mutually different, with respect to the second triggering event; and (f) executing the second triggering event in cases in which another predetermined condition is fulfilled during the basic game, and executing the one of the second bonus games, among the plurality of second bonus games associated with the one predetermined condition with respect to the second triggering event, in cases in which the one of the predetermined conditions is fulfilled, with respect to the second triggering event.

2. The gaming apparatus according to claim 1, wherein, in one of the plurality of bonus games, the controller selects one of the plurality of types of symbols appearing on the plurality of display areas on the display; and wherein the controller selects and executes another bonus game according to the selected type of symbol.

3. The gaming apparatus according to claim 1, wherein said controller performs an operation to determine whether the first bonus game is being executed before determining if the predetermined condition has been satisfied or if the predetermined result of the first bonus game has been accomplished.

4. The gaming apparatus according to claim 1, wherein said controller performs an operation for determining whether the first bonus game is being executed.

5. The gaming apparatus according to claim 1, wherein said controller determines whether the first bonus game is to be started before the operation for determining the win based on the arrangement of the symbols and whether the first bonus game is still being executed.

6. The gaming apparatus according to claim 1, wherein said controller performs an operation for starting the first bonus game before the operation for determining the win based on the arrangement of the symbols.

7. A slot machine which includes a display having a plurality of display areas in which a plurality of types of symbols are variably displayed, and which determines occurrence of a win based on an arrangement of symbols appearing in the respective display areas, the machine comprising:

(a) means for receiving a bet by a player, deciding a symbol, from among the plurality of symbols, to be displayed in each of the display areas, and executing a basic game that decides a prize, based on an arrangement of the symbols displayed in each of the display areas;

(b) means for executing a first triggering event, during said basic game, associated with a plurality of first bonus games and a second triggering event associated with a plurality of second bonus games, in cases in which a predetermined condition is fulfilled during the basic game;

(c) means for executing one of the first bonus games, among the plurality of first bonus games in response to said first triggering event and resulting from one predetermined condition among a plurality of predetermined conditions with respect to the plurality of first triggering events;

(d) means for executing the second triggering event during said first bonus games, said second triggering event associated with another predetermined condition with respect to the first triggering event, in cases in which another predetermined condition is fulfilled, among the plurality of predetermined conditions with respect to the first triggering event;

(e) means for executing one of the second bonus games, among the plurality of second bonus games in response to said second triggering event resulting from the fulfillment of the one predetermined condition with respect to the second triggering event; and (f) means for executing the second triggering event when another predetermined condition is fulfilled during the basic game, and executes one of the second bonus games, among the plurality of second bonus games associated with the one predetermined condition with respect to the second triggering event, in cases in which the one of the predetermined conditions is fulfilled, with respect to the second triggering event.

8. The slot machine according to claim 7, comprising:

selection means for selecting one of the plurality of types of symbols appearing in the plurality of display areas on the display in one of the plurality of bonus games; and storage means for storing a table showing a respective correspondence between the plurality of types of symbols and contents, including the bonus games, of bonuses to be awarded to the player, wherein the execution means executes a bonus game based on the respective correspondence in the table stored in the storage means according to the type of the symbol selected in the another bonus game.

9. The slot machine according to claim 7, further comprising: a controller for determining whether the another bonus game is being executed before determining if the predetermined condition has been satisfied in the basic game or if the predetermined result of the another bonus game has been accomplished.

10. The slot machine according to claim 7, further comprising:

means for determining whether the another bonus game is being executed.

11. The slot machine according to claim 7, further comprising:

means for determining whether the another bonus game is to be started before determining occurrence of the win based on the arrangement of the symbols; and means for determining whether the another bonus game is still being executed.

12. The slot machine according to claim 7, further comprising:

means for starting the another bonus game before determining occurrence of the win based on the arrangement of the symbols.

13. A method for controlling a gaming apparatus which includes a display having a plurality of display areas in which a plurality of types of symbols are variably displayed, and a controller for controlling details to be displayed on the display, the method comprising:

(a) receiving a bet by a player, deciding a symbol, from among the plurality of symbols, to be displayed in each of the display areas, and executing a basic game that decides a prize, based on an arrangement of the symbols displayed in each of the display areas;

(b) executing a first triggering event during said basic game, associating a plurality of first bonus games and a second triggering event associated with a plurality of second bonus games, in cases in which a predetermined condition is fulfilled during the basic game;

(c) executing one of the first bonus games, among the plurality of first bonus games in response to said first triggering event resulting from one predetermined condition being fulfilled among a plurality of predetermined conditions that are mutually different;

(d) executing the second triggering event during at least one of said first bonus games associated with another predetermined condition with respect to the first triggering event, in cases in which another predetermined condition is fulfilled, among the plurality of predetermined conditions with respect to the first triggering event;

(e) executing one of the second bonus games, among the plurality of second bonus games in response to said second triggering event resulting from a fulfillment of the one predetermined condition among a plurality of predetermined conditions with respect to the second triggering event; and (f) executing the second triggering event in cases in which another predetermined condition is fulfilled during the basic game, and executes the one of the second bonus games, among the plurality of second bonus games associated with the one predetermined condition with respect to the second triggering event, in cases in which the one of the predetermined conditions is fulfilled, with respect to the second triggering event.

14. The method for controlling the gaming apparatus according to claim 13, further comprising:

selecting at least one of the plurality of types of symbols appearing in the plurality of display areas on the display in one of the plurality of bonus games; and executing yet another bonus game according to the type of the selected symbol.

15. The method according to claim 13, further comprising: determining whether the another bonus game is being executed before determining if the predetermined condition has been satisfied in the basic game or if the predetermined result of the another bonus game has been accomplished.

16. The method according to claim 13, further comprising:

determining whether the another bonus game is being executed.

17. The method according to claim 13, further comprising:

determining whether the another bonus game is to be started before the win is determined based on the arrangement of the symbols displayed in the respective display areas and determining whether the another bonus game is still being executed.

18. The method according to claim 13, further comprising:

starting the another bonus game before the win based on the arrangement of the symbols displayed in the respective display areas is determined.

19. A computer readable storage medium to perform the following steps:

(a) receiving a bet by a player, deciding a symbol, from among the plurality of symbols, to be displayed in each of the display areas, and executing a basic game that decides a prize, based on an arrangement of the symbols displayed in each of the display areas;

(b) executing a first triggering event, associating a plurality of first bonus games and a second triggering event associated with a plurality of second bonus games, in cases in which a predetermined condition is fulfilled during the basic game;

(c) executing one of the first bonus games, among the plurality of first bonus games in response to said first triggering event and resulting from one predetermined condition being fulfilled among a plurality of predetermined conditions with respect to the plurality of first triggering events;

(d) executing the second triggering event during said first bonus games, said second triggering event associated with another predetermined condition with respect to the first triggering event, in cases in which another predetermined condition is fulfilled, among the plurality of predetermined conditions with respect to the first triggering event;

(e) executing one of the second bonus games, among the plurality of second bonus games in response to said second triggering event and resulting from the one predetermined condition with respect to the second triggering event, in cases in which one of the predetermined conditions is fulfilled, among a plurality of predetermined conditions that are mutually different, with respect to the second triggering event; and (f) executing the second triggering event in cases in which another predetermined condition is fulfilled during the basic game, and executing the one of the second bonus games, among the plurality of second bonus games associated with the one predetermined condition with respect to the second triggering event, in cases in which the one of the predetermined conditions is fulfilled, with respect to the second triggering event.

20. The a computer readable storage medium as in claim 19, the program executing the following additional step:

determining whether the another bonus game is being executed before determining if the predetermined condition has been satisfied in the basic game or if the predetermined result of the another bonus game has been accomplished.

21. The computer readable storage medium as in claim 19, the program executing the following additional step:

determining whether the another bonus game is being executed.

22. The computer readable storage medium as in claim 19, the program to perform the following additional steps:

determining whether the another bonus game is to be started before determining the win based on the arrangement of the symbols; and determining whether the another bonus game is still being executed.

23. The computer readable storage medium as in claim 19, the program to perform the following additional step:

starting the another bonus game before determining the win based on the arrangement of the symbols.

24. A gaming apparatus comprising:

a display having a plurality of display areas in which a plurality of types of symbols are changeably displayed;

a plurality of reels having a plurality of symbols; and a controller for executing a prescribed program and for controlling display content of the reels and the display, wherein the controller, in accordance with the program, (a) receives a bet by a player, decides a symbol, from among the plurality of symbols, to be displayed in each of the display areas, and executes a basic game that decides a prize, based on an arrangement of the symbols displayed in each of the display areas;

(b) executing a first triggering event, for starting a plurality of first bonus games and a second triggering for starting a plurality of second bonus games, in cases in which a predetermined condition is fulfilled during the basic game;

(c) executing one of the first bonus games, among the plurality of first bonus games, in response to the first triggering event associated with one predetermined condition among a plurality of predetermined conditions with respect to the plurality of first triggering events, in cases in which one of the predetermined conditions is fulfilled, among a plurality of predetermined conditions that are mutually different, with respect to the first triggering event;

(d) executing the second triggering event during said first bonus games, said second triggering event associated with another predetermined condition with respect to the first triggering event, in cases in which another predetermined condition is fulfilled, among the plurality of predetermined conditions with respect to the first triggering event;

(e) executing one of the second bonus games, among the plurality of second bonus games, and in response to the second triggering event which is associated with the one predetermined condition with respect to the second triggering event, in cases in which one of the predetermined conditions is fulfilled, among a plurality of predetermined conditions that are mutually different, with respect to the second triggering event; and (f) executing the second triggering event in cases in which another predetermined condition is fulfilled during the basic game, and executes the one of the second bonus games, among the plurality of second bonus games associated with the one predetermined condition with respect to the second triggering event, in cases in which the one of the predetermined conditions is fulfilled, with respect to the second triggering event.

25. The gaming apparatus as in claim 24, wherein said first triggering event is a lottery event by a random number and which is performed prior to the spinning of reels in the basic game.

26. The gaming apparatus as in claim 24, wherein said plurality of second bonus games are mutually different types of bonus games.

27. The gaming apparatus as in claim 24, wherein said plurality of first bonus games and said plurality of second bonus games are the same bonus games.

* * * * *